US012471622B2

(12) United States Patent
Nesovic

(10) Patent No.: US 12,471,622 B2
(45) Date of Patent: Nov. 18, 2025

(54) AEROSOL-GENERATING ARTICLE WITH PREDETERMINED INSERTION DIRECTION

(71) Applicant: Philip Morris Products S.A., Neuchatel (CH)

(72) Inventor: Milica Nesovic, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 394 days.

(21) Appl. No.: 17/904,256

(22) PCT Filed: Feb. 24, 2021

(86) PCT No.: PCT/EP2021/054590

§ 371 (c)(1),
(2) Date: Aug. 15, 2022

(87) PCT Pub. No.: WO2021/170671

PCT Pub. Date: Sep. 2, 2021

(65) Prior Publication Data

US 2023/0098321 A1 Mar. 30, 2023

(30) Foreign Application Priority Data

Feb. 28, 2020 (EP) ..... 20160247

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/02* (2013.01); *A24D 1/042* (2013.01); *A24F 40/20* (2020.01); *A24F 40/465* (2020.01)

(58) Field of Classification Search
CPC ..... A24D 1/20; A24F 40/465
See application file for complete search history.

(56) References Cited

U.S. PATENT DOCUMENTS 10,548,350 B2 * 2/2020 Greim ..... A24F 40/40
2006/0254607 A1 11/2006 Borgognon et al.
(Continued)

FOREIGN PATENT DOCUMENTS

CN 107981411 A 5/2018
EP 3 243 393 A1 11/2017
(Continued)

OTHER PUBLICATIONS

International Search Report and Written Opinion issued May 6, 2021, in PCT/EP2021/054590 filed Feb. 24, 2021, 5 pages.
(Continued)

*Primary Examiner* — Russell E Sparks
(74) *Attorney, Agent, or Firm* — Oblon, McClelland, Maier & Neustadt, L.L.P.

(57) ABSTRACT

An aerosol-generating article is provided, extending from a mouth end to an upstream distal end, and including: a rod of aerosol-generating substrate; a downstream section at a location downstream of the rod and including a mouthpiece element downstream of and in longitudinal alignment with the rod, the element extending all the way to the mouth end; an upstream section upstream of the rod and including an upstream element including a segment of filtration material and extending all the way to a distal end of the article; and a first band of tipping paper at least partially circumscribing the mouthpiece element and affixing the mouthpiece to an immediately adjacent, upstream component of the article, and a second band of tipping paper circumscribing the first band, an article diameter (DME) at the mouth end being greater than an article diameter (DDE) at the distal end, a ratio (DME/DDE) being at least 1.005.

10 Claims, 1 Drawing Sheet

Figure 1:
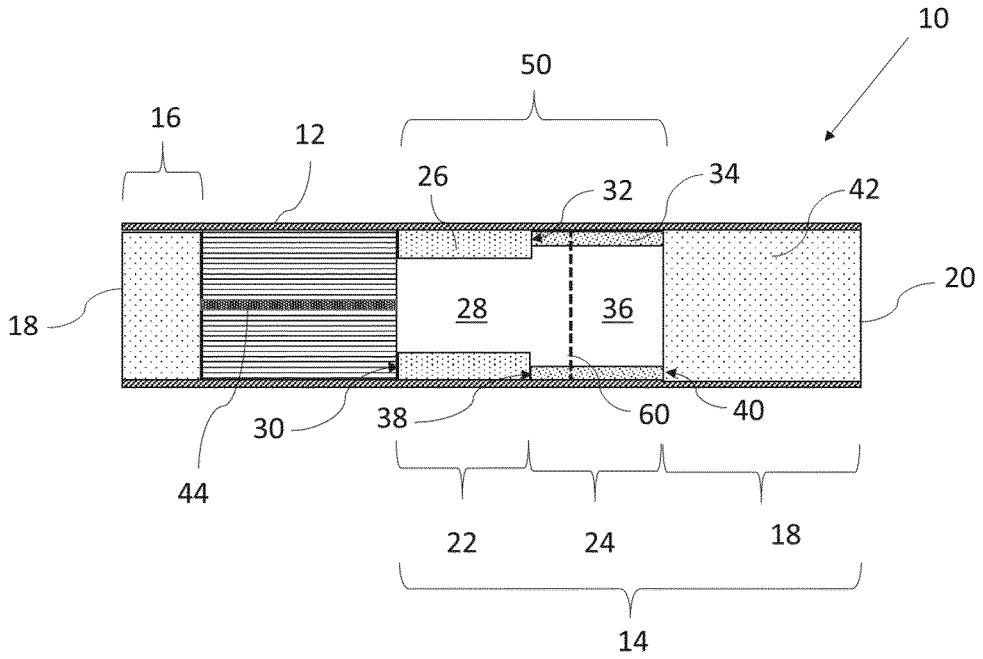

(51) Int. Cl.

| | |
|---|---|
| ***A24D 1/04*** | (2006.01) |
| ***A24F 40/465*** | (2020.01) |
| *A24F 40/20* | (2020.01) |

(56) References Cited

U.S. PATENT DOCUMENTS

| | | | | |
|---|---|---|---|---|
| 2008/0156336 | A1* | 7/2008 | Wyss-Peters | A24D 3/061 131/88 |
| 2011/0290269 | A1 | 12/2011 | Shimizu | |
| 2016/0128378 | A1 | 5/2016 | Kuersteiner et al. | |
| 2018/0116275 | A1 | 5/2018 | Malgat et al. | |
| 2019/0075845 | A1 | 3/2019 | Malgat et al. | |
| 2019/0090539 | A1 | 3/2019 | Rostami et al. | |
| 2019/0124974 | A1 | 5/2019 | Dimmick et al. | |
| 2022/0007709 | A1* | 1/2022 | Uthurry | A24D 1/20 |

FOREIGN PATENT DOCUMENTS

| | | | |
|---|---|---|---|
| JP | 2014-509872 | A | 4/2014 |
| JP | 2017-531435 | A | 10/2017 |
| JP | 2019-512235 | A | 5/2019 |
| RU | 2 609 394 | C2 | 2/2017 |
| RU | 2 665 435 | C1 | 8/2018 |
| WO | WO 96/32854 | A2 | 10/1996 |
| WO | WO 2012/164009 | A2 | 12/2012 |
| WO | WO 2013/098405 | A2 | 7/2013 |
| WO | WO 2014/086998 | A1 | 6/2014 |
| WO | WO 2015/176898 | A1 | 11/2015 |
| WO | WO 2016/156219 | A1 | 10/2016 |
| WO | WO 2016/156223 | A1 | 10/2016 |
| WO | WO 2017/153443 | A1 | 9/2017 |
| WO | WO 2017/207672 | A1 | 12/2017 |
| WO | WO 2018/172389 | A1 | 9/2018 |
| WO | WO 2018/190605 | A2 | 10/2018 |
| WO | WO 2019/057857 | A1 | 3/2019 |
| WO | WO 2019/072962 | A1 | 4/2019 |
| WO | WO 2019/193208 | A1 | 10/2019 |
| WO | WO 2019/193209 | A1 | 10/2019 |
| WO | WO 2019/193210 | A1 | 10/2019 |
| WO | WO 2020/009415 | A1 | 1/2020 |
| WO | WO 2020/115151 | A1 | 6/2020 |
| WO | WO 2020/127102 | A2 | 6/2020 |
| WO | WO 2020/127107 | A1 | 6/2020 |
| WO | WO 2020/127111 | A2 | 6/2020 |
| WO | WO 2020/127116 | A2 | 6/2020 |
| WO | WO 2020/128043 | A1 | 6/2020 |
| WO | WO 2020/128045 | A1 | 6/2020 |
| WO | WO 2020/128048 | A1 | 6/2020 |
| WO | WO 2021/110541 | A1 | 6/2021 |

OTHER PUBLICATIONS

International Preliminary Report on Patentability issued May 25, 2022, in PCT/EP2021/054590 filed Feb. 24, 2021

Combined Russian Office Action and Search Report issued Jun. 10, 2024 in Russian Patent Application No. 2022125216/03 (with English Translation of Office Action only), 10 pages.

Extended European Search Report issued Sep. 10, 2020, in corresponding European Patent Application No. 20160247.1, 9 pages.

Japanese Office Action issued Jan. 30, 2025 in Japanese Patent Application No. 2022-551403 (with unedited computer-generated English Translation), 20 pages.

* cited by examiner

AEROSOL-GENERATING ARTICLE WITH PREDETERMINED INSERTION DIRECTION

The present invention relates to an aerosol-generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor arranged within the aerosol-generating substrate have been proposed by WO 2015/176898.

Aerosol-generating articles in which a tobacco-containing substrate is heated rather than combusted present a number of challenges that were not encountered with conventional smoking articles. First of all, tobacco-containing substrates are typically heated to significantly lower temperatures compared with the temperatures reached by the combustion front in a conventional cigarette. This may have an impact on nicotine release from the tobacco-containing substrate and nicotine delivery to the consumer. At the same time, if the heating temperature is increased in an attempt to boost nicotine delivery, then the aerosol generated typically needs to be cooled to a greater extent and more rapidly before it reaches the consumer. However, technical solutions that were commonly used for cooling the mainstream smoke in conventional smoking articles, such as the provision of a high filtration efficiency segment at the mouth end of a cigarette, may have undesirable effects in an aerosol-generating article wherein a tobacco-containing substrate is heated rather than combusted, as they may reduce nicotine delivery. Secondly, a need is generally felt for aerosol-generating articles that are easy to use and have improved practicality.

Further, it would be desirable to provide one such aerosol-generating article that can be manufactured efficiently and at high speed, preferably with a satisfactory RTD and low RTD variability from one article to another.

Therefore, it would be desirable to provide a new and improved aerosol-generating article adapted to achieve at least one of the desirable results described above.

The present disclosure relates to an aerosol-generating article comprising a rod of aerosol-generating substrate, wherein the aerosol-generating article extends from a mouth end to a distal end upstream from the mouth end. The aerosol-generating article may comprise a downstream section at a location downstream of the rod of aerosol-generating substrate. The downstream section may comprise a mouthpiece segment positioned downstream of the rod and in longitudinal alignment with the rod. The mouthpiece segment may extend all the way to the mouth end of the aerosol-generating article. A diameter ($D_{ME}$) of the aerosol-generating article at the mouth end may be greater than a diameter ($D_{DE}$) of the aerosol-generating article at the distal end. A ratio ($D_{ME}/D_{DE}$) between the diameter of the aerosol-generating article at the distal end and the diameter of the aerosol-generating article at the mouth end may be at least about 1.005.

According to the present invention, there is provided an aerosol-generating article extending from a mouth end to a distal end upstream from the mouth end, the aerosol-generating article comprising a rod of aerosol-generating substrate and a downstream section at a location downstream of the rod of aerosol-generating substrate. The downstream section comprises a mouthpiece segment positioned downstream of the rod and in longitudinal alignment with the rod, the mouthpiece segment extending all the way to the mouth end of the aerosol-generating article. A diameter ($D_{ME}$) of the aerosol-generating article at the mouth end is greater than a diameter ($D_{DE}$) of the aerosol-generating article at the distal end, a ratio ($D_{ME}/D_{DE}$) between the diameter of the aerosol-generating article at the mouth end and the diameter of the aerosol-generating article at the distal end being at least about 1.005.

Providing one such aerosol-generating article wherein an outer diameter of the article is greater at one end than at the other end has the advantage that it becomes easier for the consumer to identify the end that is to be inserted into an aerosol-generating device for supplying heat to the aerosol-generating substrate. This is especially advantageous in those embodiments wherein the distal end and the mouth end of the aerosol-generating article may be otherwise difficult to tell apart for the consumer, for example because they are visually almost identical or because both comprise similar elements. By way of example, the invention is particularly advantageous in those embodiments comprising an upstream section at a location upstream of the rod of aerosol-generating substrate, wherein the upstream section comprises an upstream element comprising a segment of filtration material, and a downstream section at a location downstream of the aerosol-generating substrate, wherein the downstream section comprises a mouthpiece segment extending all the way to a mouth end of the article. With one such article design, it might otherwise be difficult for the consumer to distinguish the mouth end—wherein the mouthpiece segment is provided—from the distal end—wherein the upstream element is provided. The present invention enables the consumer to easily detect the decrease in diameter going towards the distal end, which is the end to be inserted into a cavity of the device.

In accordance with the present invention there is provided an aerosol-generating article for generating an inhalable aerosol upon heating. The aerosol-generating article comprises a rod of aerosol-generating substrate.

The term "aerosol generating article" is used herein to denote an article wherein an aerosol generating substrate is heated to produce an deliver inhalable aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822760.

As used herein, the term "aerosol generating device" refers to a device comprising a heater element that interacts with the aerosol generating substrate of the aerosol generating article to generate an aerosol.

As used herein with reference to the present invention, the term "rod" is used to denote a generally cylindrical element of substantially circular, oval or elliptical cross-section.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The aerosol-generating substrate may be a solid aerosol-generating substrate.

In certain preferred embodiments, the aerosol-generating substrate comprises homogenised plant material, preferably a homogenised tobacco material.

As used herein, the term "homogenised plant material" encompasses any plant material formed by the agglomeration of particles of plant. For example, sheets or webs of homogenised tobacco material for the aerosol-generating substrates of the present invention may be formed by agglomerating particles of tobacco material obtained by pulverising, grinding or comminuting plant material and optionally one or more of tobacco leaf lamina and tobacco leaf stems. The homogenised plant material may be produced by casting, extrusion, paper making processes or other any other suitable processes known in the art.

The homogenised plant material can be provided in any suitable form. For example, the homogenised plant material may be in the form of one or more sheets. As used herein with reference to the invention, the term "sheet" describes a laminar element having a width and length substantially greater than the thickness thereof.

Alternatively or in addition, the homogenised plant material may be in the form of a plurality of pellets or granules.

Alternatively or in addition, the homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

In some embodiments, the strands may be formed in situ within the aerosol-generating substrate as a result of the splitting or cracking of a sheet of homogenised plant material during formation of the aerosol-generating substrate, for example, as a result of crimping. The strands of homogenised plant material within the aerosol-generating substrate may be separate from each other. Alternatively, each strand of homogenised plant material within the aerosol-generating substrate may be at least partially connected to an adjacent strand or strands along the length of the strands. For example, adjacent strands may be connected by one or more fibres. This may occur, for example, where the strands have been formed due to the splitting of a sheet of homogenised plant material during production of the aerosol-generating substrate, as described above.

Preferably, the aerosol-generating substrate is in the form of one or more sheets of homogenised plant material. In various embodiments of the invention, the one or more sheets of homogenised plant material may be produced by a casting process. In various embodiments of the invention, the one or more sheets of homogenised plant material may be produced by a paper-making process. The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the aerosol-generating substrate is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 grams per square metre and about 300 grams per square metre.

The one or more sheets as described herein may each individually have a density of from about 0.3 grams per cubic centimetre to about 1.3 grams per cubic centimetre, and preferably from about 0.7 grams per cubic centimetre to about 1.0 gram per cubic centimetre.

In embodiments of the present invention in which the aerosol-generating substrate comprises one or more sheets of homogenised plant material, the sheets are preferably in the form of one or more gathered sheets. As used herein, the term "gathered" denotes that the sheet of homogenised plant material is convoluted, folded, or otherwise compressed or constricted substantially transversely to the cylindrical axis of a plug or a rod.

The one or more sheets of homogenised plant material may be gathered transversely relative to the longitudinal axis thereof and circumscribed with a wrapper to form a continuous rod or a plug.

The one or more sheets of homogenised plant material may advantageously be crimped or similarly treated. As used herein, the term "crimped" denotes a sheet having a plurality of substantially parallel ridges or corrugations. Alternatively or in addition to being crimped, the one or more sheets of homogenised plant material may be embossed, debossed, perforated or otherwise deformed to provide texture on one or both sides of the sheet.

Preferably, each sheet of homogenised plant material may be crimped such that it has a plurality of ridges or corrugations substantially parallel to the cylindrical axis of the plug. This treatment advantageously facilitates gathering of the crimped sheet of homogenised plant material to form the plug. Preferably, the one or more sheets of homogenised plant material may be gathered. It will be appreciated that crimped sheets of homogenised plant material may alternatively or in addition have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

Alternatively, the one or more sheets of homogenised plant material may be cut into strands as referred to above. In such embodiments, the aerosol-generating substrate comprises a plurality of strands of the homogenised plant material. The strands may be used to form a plug. Typically, the width of such strands is about 5 millimeters, or about 4 millimeters, or about 3 millimeters, or about 2 millimeters or less. The length of the strands may be greater than about 5 millimeters, between about 5 millimeters to about 15 millimeters, about 8 millimeters to about 12 millimeters, or about 12 millimeters. Preferably, the strands have substantially the same length as each other. The length of the strands may be determined by the manufacturing process whereby a rod is cut into shorter plugs and the length of the strands corresponds to the length of the plug. The strands may be fragile which may result in breakage especially during transit. In such cases, the length of some of the strands may be less than the length of the plug.

The plurality of strands preferably extend substantially longitudinally along the length of the aerosol-generating substrate, aligned with the longitudinal axis. Preferably, the plurality of strands are therefore aligned substantially parallel to each other.

The homogenised plant material may comprise up to about 95 percent by weight of plant particles, on a dry weight basis. Preferably, the homogenised plant material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised plant material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

In certain embodiments of the invention, the homogenised plant material is a homogenised tobacco material comprising tobacco particles. Sheets of homogenised tobacco material for use in such embodiments of the invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

With reference to the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. In a preferred embodiment, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, and other specialty tobaccos.

Flue-curing is a method of curing tobacco, which is particularly used with Virginia tobaccos. During the flue-curing process, heated air is circulated through densely packed tobacco. During a first stage, the tobacco leaves turn yellow and wilt. During a second stage, the laminae of the leaves are completely dried. During a third stage, the leaf stems are completely dried.

Burley tobacco plays a significant role in many tobacco blends. Burley tobacco has a distinctive flavour and aroma and also has an ability to absorb large amounts of casing.

Oriental is a type of tobacco which has small leaves, and high aromatic qualities. However, Oriental tobacco has a milder flavour than, for example, Burley. Generally, therefore, Oriental tobacco is used in relatively small proportions in tobacco blends.

Kasturi, Madura and Jatim are subtypes of sun-cured tobacco that can be used. Preferably, Kasturi tobacco and flue-cured tobacco may be used in a blend to produce the tobacco particles. Accordingly, the tobacco particles in the particulate plant material may comprise a blend of Kasturi tobacco and flue-cured tobacco.

The tobacco particles may have a nicotine content of at least about 2.5 percent by weight, based on dry weight. More preferably, the tobacco particles may have a nicotine content of at least about 3 percent, even more preferably at least about 3.2 percent, even more preferably at least about 3.5 percent, most preferably at least about 4 percent by weight, based on dry weight.

In certain other embodiments of the invention, the homogenised plant material comprises tobacco particles in combination with non-tobacco plant flavour particles. Preferably, the non-tobacco plant flavour particles are selected from one or more of: ginger particles, *eucalyptus* particles, clove particles and star anise particles. Preferably, in such embodiments, the homogenised plant material comprises at least about 2.5 percent by weight of the non-tobacco plant flavour particles, on a dry weight basis, with the remainder of the plant particles being tobacco particles. Preferably, the homogenised plant material comprises at least about 4 percent by weight of non-tobacco plant flavour particles, more preferably at least about 6 percent by weight of non-tobacco plant flavour particles, more preferably at least about 8 percent by weight of non-tobacco plant flavour particles and more preferably at least about 10 percent by weight of non-tobacco plant flavour particles, on a dry weight basis. Preferably, the homogenised plant material comprises up to about 20 percent by weight of non-tobacco plant flavour particles, more preferably up to about 18 percent by weight of non-tobacco plant flavour particles, more preferably up to about 16 percent by weight of non-tobacco plant flavour particles.

The weight ratio of the non-tobacco plant flavour particles and the tobacco particles in the particulate plant material forming the homogenised plant material may vary depending on the desired flavour characteristics and composition of the aerosol produced from the aerosol-generating substrate during use. Preferably, the homogenised plant material comprises at least a 1:30 weight ratio of non-tobacco plant flavour particles to tobacco particles, more preferably at least a 1:20 weight ratio of non-tobacco plant flavour particles to tobacco particles, more preferably at least a 1:10 weight ratio of non-tobacco plant flavour particles to tobacco particles and most preferably at least a 1:5 weight ratio of non-tobacco plant flavour particles to tobacco particles, on a dry weight basis.

Alternatively or in addition to the inclusion of tobacco particles into the homogenised plant material of the aerosol-generating substrate according to the invention, the homogenised plant material may comprise *cannabis* particles. The term "*cannabis* particles" refers to particles of a *cannabis* plant, such as the species *Cannabis sativa, Cannabis indica*, and *Cannabis ruderalis*.

The homogenised plant material preferably comprises no more than 95 percent by weight of the particulate plant material, on a dry weight basis. The particulate plant material is therefore typically combined with one or more other components to form the homogenised plant material.

The homogenised plant material may further comprise a binder to alter the mechanical properties of the particulate plant material, wherein the binder is included in the homogenised plant material during manufacturing as described herein. Suitable exogenous binders would be known to the skilled person and include but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder comprises guar gum.

The binder may be present in an amount of from about 1 percent to about 10 percent by weight, based on the dry weight of the homogenised plant material, preferably in an amount of from about 2 percent to about 5 percent by weight, based on the dry weight of the homogenised plant material.

Alternatively or in addition, the homogenised plant material may further comprise one or more lipids to facilitate the diffusivity of volatile components (for example, aerosol formers, gingerols and nicotine), wherein the lipid is included in the homogenised plant material during manufacturing as described herein. Suitable lipids for inclusion in the homogenised plant material include, but are not limited to: medium-chain triglycerides, cocoa butter, palm oil, palm kernel oil, mango oil, shea butter, soybean oil, cottonseed oil, coconut oil, hydrogenated coconut oil, candelilla wax, carnauba wax, shellac, sunflower wax, sunflower oil, rice bran, and Revel A; and combinations thereof.

Alternatively or in addition, the homogenised plant material may further comprise a pH modifier.

Alternatively or in addition, the homogenised plant material may further comprise fibres to alter the mechanical properties of the homogenised plant material, wherein the fibres are included in the homogenised plant material during manufacturing as described herein. Suitable exogenous fibres for inclusion in the homogenised plant material are known in the art and include fibres formed from non-tobacco material and non-ginger material, including but not limited to: cellulose fibres; soft-wood fibres; hard-wood fibres; jute fibres and combinations thereof. Exogenous fibres derived from tobacco and/or ginger can also be added. Any fibres added to the homogenised plant material are not considered to form part of the "particulate plant material" as defined above. Prior to inclusion in the homogenised plant material, fibres may be treated by suitable processes known in the art including, but not limited to: mechanical pulping; refining; chemical pulping; bleaching; sulphate pulping; and combinations thereof. A fibre typically has a length greater than its width.

Suitable fibres typically have lengths of greater than 400 micrometres and less than or equal to 4 millimeters, preferably within the range of 0.7 millimeters to 4 millimeters. Preferably, the fibres are present in an amount of about 2 percent to about 15 percent by weight, most preferably at about 4 percent by weight, based on the dry weight of the substrate.

Alternatively or in addition, the homogenised plant material may further comprise one or more aerosol formers. Upon volatilisation, an aerosol former can convey other vaporised compounds released from the aerosol-generating substrate upon heating, such as nicotine and flavourants, in an aerosol. Suitable aerosol formers for inclusion in the homogenised plant material are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The homogenised plant material may have an aerosol former content of between about 5 percent and about 30 percent by weight on a dry weight basis, such as between about 10 percent and about 25 percent by weight on a dry weight basis, or between about 15 percent and about 20 percent by weight on a dry weight basis.

For example, if the substrate is intended for use in an aerosol-generating article for an electrically-operated aerosol-generating system having a heating element, it may preferably include an aerosol former content of between about 5 percent to about 30 percent by weight on a dry weight basis. If the substrate is intended for use in an aerosol-generating article for an electrically-operated aerosol-generating system having a heating element, the aerosol former is preferably glycerol.

In other embodiments, the homogenised plant material may have an aerosol former content of about 1 percent to about 5 percent by weight on a dry weight basis. For example, if the substrate is intended for use in an aerosol-generating article in which aerosol former is kept in a reservoir separate from the substrate, the substrate may have an aerosol former content of greater than 1 percent and less than about 5 percent. In such embodiments, the aerosol former is volatilised upon heating and a stream of the aerosol former is contacted with the aerosol-generating substrate so as to entrain the flavours from the aerosol-generating substrate in the aerosol.

In other embodiments, the homogenised plant material may have an aerosol former content of about 30 percent by weight to about 45 percent by weight. This relatively high level of aerosol former is particularly suitable for aerosol-generating substrates that are intended to be heated at a temperature of less than 275 degrees Celsius. In such embodiments, the homogenised plant material preferably further comprises between about 2 percent by weight and about 10 percent by weight of cellulose ether, on a dry weight basis and between about 5 percent by weight and about 50 percent by weight of additional cellulose, on a dry weight basis. The use of the combination of cellulose ether and additional cellulose has been found to provide a particularly effective delivery of aerosol when used in an aerosol-generating substrate having an aerosol former content of between 30 percent by weight and 45 percent by weight.

Suitable cellulose ethers include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). In particularly preferred embodiments, the cellulose ether is carboxymethyl cellulose.

As used herein, the term "additional cellulose" encompasses any cellulosic material incorporated into the homogenised plant material which does not derive from the non-tobacco plant particles or tobacco particles provided in the homogenised plant material. The additional cellulose is therefore incorporated in the homogenised plant material in addition to the non-tobacco plant material or tobacco material, as a separate and distinct source of cellulose to any cellulose intrinsically provided within the non-tobacco plant particles or tobacco particles. The additional cellulose will typically derive from a different plant to the non-tobacco plant particles or tobacco particles. Preferably, the additional cellulose is in the form of an inert cellulosic material, which is sensorially inert and therefore does not substantially impact the organoleptic characteristics of the aerosol generated from the aerosol-generating substrate. For example, the additional cellulose is preferably a tasteless and odorless material.

The additional cellulose may comprise cellulose powder, cellulose fibres, or a combination thereof.

The aerosol former may act as a humectant in the aerosol-generating substrate.

The wrapper circumscribing the rod of homogenised plant material may be a paper wrapper or a non-paper wrapper. Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to sheets of homogenised tobacco materials. In certain preferred embodiments, the wrapper may be formed of a laminate material comprising a plurality of layers. Preferably, the wrapper is formed of an aluminium co-laminated sheet. The use of a co-laminated sheet comprising aluminium advantageously prevents combustion of the aerosol-generating substrate in the event that the aerosol-generating substrate should be ignited, rather than heated in the intended manner.

In certain preferred embodiments of the present invention, the aerosol-generating substrate comprises a gel composition that includes an alkaloid compound, or a cannabinoid compound, or both an alkaloid compound and a cannabinoid compound. In particularly preferred embodiments, the aerosol-generating substrate comprises a gel composition that includes nicotine.

Preferably, the gel composition comprises an alkaloid compound, or a cannabinoid compound, or both an alkaloid compound and a cannabinoid compound; an aerosol former; and at least one gelling agent. Preferably, the at least one gelling agent forms a solid medium and the glycerol is dispersed in the solid medium, with the alkaloid or cannabinoid dispersed in the glycerol. Preferably, the gel composition is a stable gel phase.

Advantageously, a stable gel composition comprising nicotine provides predictable composition form upon storage or transit from manufacture to the consumer. The stable gel composition comprising nicotine substantially maintains its shape. The stable gel composition comprising nicotine substantially does not release a liquid phase upon storage or transit from manufacture to the consumer. The stable gel composition comprising nicotine may provide for a simple consumable design. This consumable may not have to be designed to contain a liquid, thus a wider range of materials and container constructions may be contemplated.

The gel composition described herein may be combined with an aerosol-generating device to provide a nicotine aerosol to the lungs at inhalation or air flow rates that are within conventional smoking regime inhalation or air flow rates. The aerosol-generating device may continuously heat the gel composition. A consumer may take a plurality of inhalations or "puffs" where each "puff" delivers an amount of nicotine aerosol. The gel composition may be capable of delivering a high nicotine/low total particulate matter (TPM) aerosol to a consumer when heated, preferably in a continuous manner.

The phrase "stable gel phase" or "stable gel" refers to gel that substantially maintains its shape and mass when exposed to a variety of environmental conditions. The stable gel may not substantially release (sweat) or absorb water when exposed to a standard temperature and pressure while varying relative humidity from about 10 percent to about 60 percent. For example, the stable gel may substantially maintain its shape and mass when exposed to a standard temperature and pressure while varying relative humidity from about 10 percent to about 60 percent.

The gel composition includes an alkaloid compound, or a cannabinoid compound, or both an alkaloid compound and a cannabinoid compound. The gel composition may include one or more alkaloids. The gel composition may include one or more cannabinoids. The gel composition may include a combination of one or more alkaloids and one or more cannabinoids.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel composition may preferably include an alkaloid compound selected from the group consisting of nicotine, anatabine, and combinations thereof.

Preferably the gel composition includes nicotine.

The term "nicotine" refers to nicotine and nicotine derivatives such as free-base nicotine, nicotine salts and the like.

The term "cannabinoid compound" refers to any one of a class of naturally occurring compounds that are found in parts of the *cannabis* plant—namely the species *Cannabis sativa, Cannabis indica*, and *Cannabis ruderalis*. Cannabinoid compounds are especially concentrated in the female flower heads. Cannabinoid compounds naturally occurring in the *cannabis* plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

The gel may include a cannabinoid compound selected from the group consisting of cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE), cannabicitran (CBT), and combinations thereof.

The gel composition may preferably include a cannabinoid compound selected from the group consisting of cannabidiol (CBD), THC (tetrahydrocannabinol) and combinations thereof.

The gel may preferably include cannabidiol (CBD).

The gel composition may include nicotine and cannabidiol (CBD).

The gel composition may include nicotine, cannabidiol (CBD), and THC (tetrahydrocannabinol).

The gel composition preferably includes about 0.5 percent by weight to about 10 percent by weight of an alkaloid compound, or about 0.5 percent by weight to about 10 percent by weight. of a cannabinoid compound, or both an alkaloid compound and a cannabinoid compound in a total amount from about 0.5 percent by weight to about 10 percent by weight. The gel composition may include about 0.5 percent by weight to about 5 percent by weight of an alkaloid compound, or about 0.5 percent by weight to about 5 percent by weight of a cannabinoid compound, or both an alkaloid compound and a cannabinoid compound in a total amount from about 0.5 percent by weight to about 5 percent by weight. Preferably the gel composition includes about 1 percent by weight to about 3 percent by weight of an alkaloid compound, or about 1 percent by weight to about 3 percent by weight of a cannabinoid compound, or both an alkaloid compound and a cannabinoid compound in a total amount from about 1 percent by weight to about 3 percent by weight. The gel composition may preferably include about 1.5 percent by weight to about 2.5 percent by weight of an alkaloid compound, or about 1.5 percent by weight to about 2.5 percent by weight of a cannabinoid compound, or both an alkaloid compound and a cannabinoid compound in a total amount from about 1.5 percent by weight to about 2.5 percent by weight. The gel composition may preferably include about 2 percent by weight of an alkaloid compound, or about 2 percent by weight of a cannabinoid compound, or both an alkaloid compound and a cannabinoid compound in a total amount of about 2 percent by weight. The alkaloid compound component of the gel formulation may be the most volatile component of the gel formulation. In some aspects water may be the most volatile component of the gel formulation and the alkaloid compound component of the gel formulation may be the second most volatile component of the gel formulation. The cannabinoid compound component of the gel formulation may be the most volatile component of the gel formulation. In some aspects water may be the most volatile component of the gel formulation and the alkaloid compound component of the gel formulation may be the second most volatile component of the gel formulation.

Preferably nicotine is included in the gel compositions. The nicotine may be added to the composition in a free base form or a salt form. The gel composition includes about 0.5 percent by weight to about 10 percent by weight nicotine, or about 0.5 percent by weight to about 5 percent by weight nicotine. Preferably the gel composition includes about 1 percent by weight to about 3 percent by weight nicotine, or about 1.5 percent by weight to about 2.5 percent by weight nicotine, or about 2 percent by weight nicotine. The nicotine component of the gel formulation may be the most volatile component of the gel formulation. In some aspects water may be the most volatile component of the gel formulation and the nicotine component of the gel formulation may be the second most volatile component of the gel formulation.

The gel composition includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1,3-butanediol and, glycerine (glycerol or propane-1,2,3-triol) or polyethylene glycol. The aerosol-former is preferably glycerol.

The gel composition may include a majority of an aerosol-former. The gel composition may include a mixture of water and the aerosol-former where the aerosol-former forms a majority (by weight) of the gel composition. The aerosol-former may form at least about 50 percent by weight of the gel composition. The aerosol-former may form at least about 60 percent by weight or at least about 65 percent by weight or at least about 70 percent by weight of the gel composition. The aerosol-former may form about 70 percent by weight to about 80 percent by weight of the gel composition. The aerosol-former may form about 70 percent by weight to about 75 percent by weight of the gel composition.

The gel composition may include a majority of glycerol. The gel composition may include a mixture of water and the glycerol where the glycerol forms a majority (by weight) of the gel composition. The glycerol may form at least about 50 percent by weight of the gel composition. The glycerol may form at least about 60 percent by weight or at least about 65 percent by weight or at least about 70 percent by weight of the gel composition. The glycerol may form about 70 percent by weight to about 80 percent by weight of the gel composition. The glycerol may form about 70 percent by weight to about 75 percent by weight of the gel composition.

The gel composition preferably includes at least one gelling agent. Preferably, the gel composition includes a total amount of gelling agents in a range from about 0.4 percent by weight to about 10 percent by weight. More preferably, the composition includes the gelling agents in a range from about 0.5 percent by weight to about 8 percent by weight. More preferably, the composition includes the gelling agents in a range from about 1 percent by weight to about 6 percent by weight. More preferably, the composition includes the gelling agents in a range from about 2 percent by weight to about 4 percent by weight. More preferably, the composition includes the gelling agents in a range from about 2 percent by weight to about 3 percent by weight.

The term "gelling agent" refers to a compound that homogeneously, when added to a 50 percent by weight water/50 percent by weight glycerol mixture, in an amount of about 0.3 percent by weight, forms a solid medium or support matrix leading to a gel. Gelling agents include, but are not limited to, hydrogen-bond crosslinking gelling agents, and ionic crosslinking gelling agents.

The gelling agent may include one or more biopolymers. The biopolymers may be formed of polysaccharides.

Biopolymers include, for example, gellan gums (native, low acyl gellan gum, high acyl gellan gums with low acyl gellan gum being preferred), xanthan gum, alginates (alginic acid), agar, guar gum, and the like. The composition may preferably include xanthan gum. The composition may include two biopolymers. The composition may include three biopolymers. The composition may include the two biopolymers in substantially equal weights. The composition may include the three biopolymers in substantially equal weights.

Preferably, the gel composition comprises at least about 0.2 percent by weight hydrogen-bond crosslinking gelling agent. Alternatively or in addition, the gel composition preferably comprises at least about 0.2 percent by weight ionic crosslinking gelling agent. Most preferably, the gel composition comprises at least about 0.2 percent by weight hydrogen-bond crosslinking gelling agent and at least about 0.2 percent by weight ionic crosslinking gelling agent. The gel composition may comprise about 0.5 percent by weight to about 3 percent by weight hydrogen-bond crosslinking gelling agent and about 0.5 percent by weight to about 3 percent by weight ionic crosslinking gelling agent, or about 1 percent by weight to about 2 percent by weight hydrogen-bond crosslinking gelling agent and about 1 percent by weight to about 2 percent by weight ionic crosslinking gelling agent. The hydrogen-bond crosslinking gelling agent and ionic crosslinking gelling agent may be present in the gel composition in substantially equal amounts by weight.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as a N, O, or F atom and another very electronegative atom.

The hydrogen-bond crosslinking gelling agent may include one or more of a galactomannan, gelatin, agarose, or konjac gum, or agar. The hydrogen-bond crosslinking gelling agent may preferably include agar.

The gel composition preferably includes the hydrogen-bond crosslinking gelling agent in a range from about 0.3 percent by weight to about 5 percent by weight. Preferably the composition includes the hydrogen-bond crosslinking gelling agent in a range from about 0.5 percent by weight to about 3 percent by weight. Preferably the composition includes the hydrogen-bond crosslinking gelling agent in a range from about 1 percent by weight to about 2 percent by weight.

The gel composition may include a galactomannan in a range from about 0.2 percent by weight to about 5 percent by weight. Preferably the galactomannan may be in a range from about 0.5 percent by weight to about 3 percent by weight. Preferably the galactomannan may be in a range from about 0.5 percent by weight to about 2 percent by weight. Preferably the galactomannan may be in a range from about 1 percent by weight to about 2 percent by weight.

The gel composition may include a gelatin in a range from about 0.2 percent by weight to about 5 percent by weight. Preferably the gelatin may be in a range from about 0.5 percent by weight to about 3 percent by weight. Preferably the gelatin may be in a range from about 0.5 percent by weight to about 2 percent by weight. Preferably the gelatin may be in a range from about 1 percent by weight to about 2 percent by weight.

The gel composition may include agarose in a range from about 0.2 percent by weight to about 5 percent by weight. Preferably the agarose may be in a range from about 0.5 percent by weight to about 3 percent by weight. Preferably the agarose may be in a range from about 0.5 percent by weight to about 2 percent by weight. Preferably the agarose may be in a range from about 1 percent by weight to about 2 percent by weight.

The gel composition may include konjac gum in a range from about 0.2 percent by weight to about 5 percent by weight. Preferably the konjac gum may be in a range from about 0.5 percent by weight to about 3 percent by weight. Preferably the konjac gum may be in a range from about 0.5 percent by weight to about 2 percent by weight. Preferably the konjac gum may be in a range from about 1 percent by weight to about 2 percent by weight.

The gel composition may include agar in a range from about 0.2 percent by weight to about 5 percent by weight. Preferably the agar may be in a range from about 0.5 percent by weight to about 3 percent by weight. Preferably the agar may be in a range from about 0.5 percent by weight to about 2 percent by weight. Preferably the agar may be in a range from about 1 percent by weight to about 2 percent by weight.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The ionic crosslinking gelling agent may include low acyl gellan, pectin, kappa carrageenan, iota carrageenan or alginate. The ionic crosslinking gelling agent may preferably include low acyl gellan.

The gel composition may include the ionic crosslinking gelling agent in a range from about 0.3 percent by weight to about 5 percent by weight. Preferably the composition includes the ionic crosslinking gelling agent in a range from about 0.5 percent by weight to about 3 percent by weight by weight. Preferably the composition includes the ionic crosslinking gelling agent in a range from about 1 percent by weight to about 2 percent by weight.

The gel composition may include low acyl gellan in a range from about 0.2 percent by weight to about 5 percent by weight. Preferably the low acyl gellan may be in a range from about 0.5 percent by weight to about 3 percent by weight. Preferably the low acyl gellan may be in a range from about 0.5 percent by weight to about 2 percent by weight. Preferably the low acyl gellan may be in a range from about 1 percent by weight to about 2 percent by weight.

The gel composition may include pectin in a range from about 0.2 percent by weight to about 5 percent by weight. Preferably the pectin may be in a range from about 0.5 percent by weight to about 3 percent by weight. Preferably the pectin may be in a range from about 0.5 percent by weight to about 2 percent by weight. Preferably the pectin may be in a range from about 1 percent by weight to about 2 percent by weight.

The gel composition may include kappa carrageenan in a range from about 0.2 percent by weight to about 5 percent by weight. Preferably the kappa carrageenan may be in a range from about 0.5 percent by weight to about 3 percent by weight. Preferably the kappa carrageenan may be in a range from about 0.5 percent by weight to about 2 percent by weight. Preferably the kappa carrageenan may be in a range from about 1 percent by weight to about 2 percent by weight.

The gel composition may include iota carrageenan in a range from about 0.2 percent by weight to about 5 percent by weight. Preferably the iota carrageenan may be in a range from about 0.5 percent by weight to about 3 percent by weight. Preferably the iota carrageenan may be in a range from about 0.5 percent by weight to about 2 percent by weight. Preferably the iota carrageenan may be in a range from about 1 percent by weight to about 2 percent by weight.

The gel composition may include alginate in a range from about 0.2 percent by weight to about 5 percent by weight. Preferably the alginate may be in a range from about 0.5 percent by weight to about 3 percent by weight. Preferably the alginate may be in a range from about 0.5 percent by weight to about 2 percent by weight. Preferably the alginate may be in a range from about 1 percent by weight to about 2 percent by weight.

The gel composition may include the hydrogen-bond crosslinking gelling agent and ionic crosslinking gelling agent in a ratio of about 3:1 to about 1:3. Preferably the gel composition may include the hydrogen-bond crosslinking gelling agent and ionic crosslinking gelling agent in a ratio of about 2:1 to about 1:2. Preferably the gel composition may include the hydrogen-bond crosslinking gelling agent and ionic crosslinking gelling agent in a ratio of about 1:1.

The gel composition may further include a viscosifying agent. The viscosifying agent combined with the hydrogen-bond crosslinking gelling agent and the ionic crosslinking gelling agent appears to surprisingly support the solid medium and maintain the gel composition even when the gel composition comprises a high level of glycerol.

The term "viscosifying agent" refers to a compound that, when added homogeneously into a 25° C., 50 percent by weight water/50 percent by weight glycerol mixture, in an amount of 0.3 percent by weight, increases the viscosity without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity to at least 50 cPs, preferably at least 200 cPs, preferably at least 500 cPs, preferably at least 1000 cPs at a shear rate of 0.1 $s^{-1}$, without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity at least 2 times, or at least 5 times, or at least 10 times, or at least 100 times higher than before addition, at a shear rate of 0.1 $s^{-1}$, without leading to the formation of a gel, the mixture staying or remaining fluid.

The viscosity values recited herein can be measured using a Brookfield RVT viscometer rotating a disc type RV #2 spindle at 25° C. at a speed of 6 revolutions per minute (rpm). The gel composition preferably includes the viscosifying agent in a range from about 0.2 percent by weight to about 5 percent by weight. Preferably the composition includes the viscosifying agent in a range from about 0.5 percent by weight to about 3 percent by weight. Preferably the composition includes the viscosifying agent in a range from about 0.5 percent by weight to about 2 percent by weight. Preferably the composition includes the viscosifying agent in a range from about 1 percent by weight to about 2 percent by weight.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel composition may include xanthan gum in a range from about 0.2 percent by weight to about 5 percent by weight. Preferably the xanthan gum may be in a range from about 0.5 percent by weight to about 3 percent by weight. Preferably the xanthan gum may be in a range from about 0.5 percent by weight to about 2 percent by weight. Preferably the xanthan gum may be in a range from about 1 percent by weight to about 2 percent by weight.

The gel composition may include carboxymethyl-cellulose in a range from about 0.2 percent by weight to about 5 percent by weight. Preferably the carboxymethyl-cellulose may be in a range from about 0.5 percent by weight to about 3 percent by weight. Preferably the carboxymethyl-cellulose may be in a range from about 0.5 percent by weight to about 2 percent by weight. Preferably the carboxymethyl-cellulose may be in a range from about 1 percent by weight to about 2 percent by weight.

The gel composition may include microcrystalline cellulose in a range from about 0.2 percent by weight to about 5 percent by weight. Preferably the microcrystalline cellulose may be in a range from about 0.5 percent by weight to about 3 percent by weight. Preferably the microcrystalline cellulose may be in a range from about 0.5 percent by weight to about 2 percent by weight. Preferably the microcrystalline cellulose may be in a range from about 1 percent by weight to about 2 percent by weight.

The gel composition may include methyl cellulose in a range from about 0.2 percent by weight to about 5 percent by weight. Preferably the methyl cellulose may be in a range from about 0.5 percent by weight to about 3 percent by weight. Preferably the methyl cellulose may be in a range from about 0.5 percent by weight to about 2 percent by weight. Preferably the methyl cellulose may be in a range from about 1 percent by weight to about 2 percent by weight.

The gel composition may include gum Arabic in a range from about 0.2 percent by weight to about 5 percent by weight. Preferably the gum Arabic may be in a range from about 0.5 percent by weight to about 3 percent by weight. Preferably the gum Arabic may be in a range from about 0.5 percent by weight to about 2 percent by weight. Preferably the gum Arabic may be in a range from about 1 percent by weight to about 2 percent by weight.

The gel composition may include guar gum in a range from about 0.2 percent by weight to about 5 percent by weight. Preferably the guar gum may be in a range from about 0.5 percent by weight to about 3 percent by weight. Preferably the guar gum may be in a range from about 0.5 percent by weight to about 2 percent by weight. Preferably the guar gum may be in a range from about 1 percent by weight to about 2 percent by weight.

The gel composition may include lambda carrageenan in a range from about 0.2 percent by weight to about 5 percent by weight. Preferably the lambda carrageenan may be in a range from about 0.5 percent by weight to about 3 percent by weight. Preferably the lambda carrageenan may be in a range from about 0.5 percent by weight to about 2 percent by weight. Preferably the lambda carrageenan may be in a range from about 1 percent by weight to about 2 percent by weight.

The gel composition may include starch in a range from about 0.2 percent by weight to about 5 percent by weight. Preferably the starch may be in a range from about 0.5 percent by weight to about 3 percent by weight. Preferably the starch may be in a range from about 0.5 percent by weight to about 2 percent by weight. Preferably the starch may be in a range from about 1 percent by weight to about 2 percent by weight.

The gel composition may further include a divalent cation. Preferably the divalent cation includes calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1 percent by weight, or about 0.5 percent by weight.

The gel composition may further include an acid. The acid may comprise a carboxylic acid. The carboxylic acid may include a ketone group. Preferably the carboxylic acid may include a ketone group having less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel composition even over similar carboxylic acids. The carboxylic acid may assist in the gel formation. The carboxylic acid may reduce variation of the alkaloid compound concentration, or the cannabinoid compound concentration, or both the alkaloid compound concentration and the cannabinoid compound within the gel composition during storage. The carboxylic acid may reduce variation of the nicotine concentration within the gel composition during storage.

The gel composition may include a carboxylic acid in a range from about 0.1 percent by weight to about 5 percent by weight. Preferably the carboxylic acid may be in a range from about 0.5 percent by weight to about 3 percent by weight. Preferably the carboxylic acid may be in a range from about 0.5 percent by weight to about 2 percent by weight. Preferably the carboxylic acid may be in a range from about 1 percent by weight to about 2 percent by weight.

The gel composition may include lactic acid in a range from about 0.1 percent by weight to about 5 percent by weight. Preferably the lactic acid may be in a range from about 0.5 percent by weight to about 3 percent by weight. Preferably the lactic acid may be in a range from about 0.5 percent by weight to about 2 percent by weight. Preferably the lactic acid may be in a range from about 1 percent by weight to about 2 percent by weight.

The gel composition may include levulinic acid in a range from about 0.1 percent by weight to about 5 percent by weight. Preferably the levulinic acid may be in a range from about 0.5 percent by weight to about 3 percent by weight. Preferably the levulinic acid may be in a range from about 0.5 percent by weight to about 2 percent by weight. Preferably the levulinic acid may be in a range from about 1 percent by weight to about 2 percent by weight.

The gel composition preferably comprises some water. The gel composition is more stable when the composition comprises some water. Preferably the gel composition comprises at least about 1 percent by weight, or at least about 2 percent by weight, or at least about 5 percent by weight of water. Preferably the gel composition comprises at least about 10 percent by weight or at least about 15 percent by weight water.

Preferably the gel composition comprises between about 8 percent by weight to about 32 percent by weight water. Preferably the gel composition comprises from about 15 percent by weight to about 25 percent by weight water. Preferably the gel composition comprises from about 18 percent by weight to about 22 percent by weight water. Preferably the gel composition comprises about 20 percent by weight water.

Preferably, the aerosol-generating substrate comprises between about 150 mg and about 350 mg of the gel composition.

Preferably, the aerosol-generating substrate comprises a porous medium loaded with the gel composition. Advantages of a porous medium loaded with the gel composition is that the gel composition is retained within the porous medium, and this may aid manufacturing, storage or transport of the gel composition. It may assist in keeping the desired shape of the gel composition, especially during manufacture, transport, or use.

The porous medium may be any suitable porous material able to hold or retain the gel composition. Ideally the porous medium can allow the gel composition to move within it. In specific embodiments the porous medium comprises natural materials, synthetic, or semi-synthetic, or a combination thereof. In specific embodiments the porous medium comprises sheet material, foam, or fibres, for example loose fibres; or a combination thereof. In specific embodiments the porous medium comprises a woven, non-woven, or extruded material, or combinations thereof. Preferably the porous medium comprises, cotton, paper, viscose, PLA, or cellulose acetate, of combinations thereof. Preferably the porous medium comprises a sheet material, for example, cotton or cellulose acetate. In a particularly preferred embodiment, the porous medium comprises a sheet made from cotton fibres.

The porous medium used in the present invention may be crimped or shredded. In preferred embodiments, the porous medium is crimped. In alternative embodiments the porous medium comprises shredded porous medium. The crimping or shredding process can be before or after loading with the gel composition.

Crimping of the sheet material has the benefit of improving the structure to allow passageways through the structure. The passageways though the crimped sheet material assist in loading up gel, retaining gel and also for fluid to pass through the crimped sheet material. Therefore there are advantages of using crimped sheet material as the porous medium.

Shredding gives a high surface area to volume ratio to the medium thus able to absorb gel easily.

In specific embodiments the sheet material is a composite material. Preferably the sheet material is porous. The sheet material may aid manufacture of the tubular element comprising a gel. The sheet material may aid introducing an active agent to the tubular element comprising a gel. The sheet material may help stabilise the structure of the tubular element comprising a gel. The sheet material may assist transport or storage of the gel. Using a sheet material enables, or aids, adding structure to the porous medium for example by crimping of the sheet material.

The porous medium may be a thread. The thread may comprise for example cotton, paper or acetate tow. The thread may also be loaded with gel like any other porous medium. An advantage of using a thread as the porous medium is that it may aid ease of manufacturing.

The thread may be loaded with gel by any known means. The thread may be simply coated with gel, or the thread may be impregnated with gel. In the manufacture, the threads may be impregnated with gel and stored ready for use to be included in the assembly of a tubular element.

The porous medium loaded with the gel composition is preferably provided within a tubular element that forms a part of the aerosol-generating article. The term "tubular element" is used to describe a component suitable for use in an aerosol generating article. Ideally the tubular element may be longer in longitudinal length then in width but not necessarily as it may be one part of a multi-component item that ideally will be longer in its longitudinal length then its width. Typically, the tubular element is cylindrical but not necessarily. For example, the tubular element may have an oval, polygonal like triangular or rectangular or random cross section.

The tubular element preferably comprises a first longitudinal passageway. The tubular element is preferably formed of a wrapper that defines the first longitudinal passageway. The wrapper is preferably a water-resistant wrapper. This water-resistant property the wrapper may be achieved by using a water-resistant material, or by treating the material of the wrapper. It may be achieved by treating one side or both sides of the wrapper. Being water-resistant would assist in not losing structure, stiffness or rigidity. It may also assist in preventing leaks of gel or liquid, especially when gels of a fluid structure are used.

Preferably, in embodiments in which the rod of aerosol-generating substrate comprises a gel composition, as described above, the downstream section of the aerosol-generating article comprises an aerosol-cooling element having a length of less than 10 millimeters. The use of a relatively short aerosol-cooling element in combination with a gel composition has found to optimise the delivery of aerosol to the consumer. More details about the provision of an aerosol-cooling elements will be provided below.

Embodiments of the invention in which the rod of aerosol-generating substrate comprises a gel composition, as described above, preferably comprise an upstream element upstream of the rod of aerosol-generating substrate. In this case, the upstream element advantageously prevents physical contact with the gel composition. The upstream element can also advantageously compensate for any potential reduction in RTD, for example, due to evaporation of the gel composition upon heating of the rod of aerosol-generating substrate during use. Further details about the provision of one such upstream element will be described below.

In some embodiments, in an aerosol-generating article in accordance with the present invention a susceptor is arranged within the rod of aerosol-generating substrate and is in thermal contact with the aerosol-generating substrate. Preferably, the susceptor is an elongate susceptor. More preferably, the elongate susceptor is arranged substantially longitudinally within the rod of aerosol-generating substrate.

As used herein with reference to the present invention, the term "susceptor" refers to a material that can convert electromagnetic energy into heat. When located within a fluctuating electromagnetic field, eddy currents induced in the susceptor cause heating of the susceptor. As the elongate susceptor is located in thermal contact with the aerosol-generating substrate, the aerosol-generating substrate is heated by the susceptor.

When used for describing the susceptor, the term "elongate" means that the susceptor has a length dimension that is greater than its width dimension or its thickness dimension, for example greater than twice its width dimension or its thickness dimension.

The susceptor is arranged substantially longitudinally within the rod. This means that the length dimension of the elongate susceptor is arranged to be approximately parallel to the longitudinal direction of the rod, for example within plus or minus 10 degrees of parallel to the longitudinal direction of the rod. In preferred embodiments, the elongate susceptor may be positioned in a radially central position within the rod, and extends along the longitudinal axis of the rod.

Preferably, the susceptor extends all the way to a downstream end of the rod of aerosol-generating article. In some embodiments, the susceptor may extend all the way to an upstream end of the rod of aerosol-generating article. In particularly preferred embodiments, the susceptor has substantially the same length as the rod of aerosol-generating substrate, and extends from the upstream end of the rod to the downstream end of the rod.

The susceptor is preferably in the form of a pin, rod, strip or blade.

The susceptor preferably has a length from about 5 millimeters to about 15 millimeters, for example from about 6 millimeters to about 12 millimeters, or from about 8 millimeters to about 10 millimeters.

A ratio between the length of the susceptor and the overall length of the aerosol-generating article substrate may be from about 0.2 to about 0.35.

Preferably, a ratio between the length of the susceptor and the overall length of the aerosol-generating article substrate is at least about 0.22, more preferably at least about 0.24, even more preferably at least about 0.26. A ratio between the length of the susceptor and the overall length of the aerosol-generating article substrate is preferably less than about 0.34, more preferably less than about 0.32, even more preferably less than about 0.3.

In some embodiments, a ratio between the length of the susceptor and the overall length of the aerosol-generating article substrate is preferably from about 0.22 to about 0.34, more preferably from about 0.24 to about 0.34, even more preferably from about 0.26 to about 0.34. In other embodiments, a ratio between the length of the susceptor and the overall length of the aerosol-generating article substrate is preferably from about 0.22 to about 0.32, more preferably from about 0.24 to about 0.32, even more preferably from about 0.26 to about 0.32. In further embodiments, a ratio between the length of the susceptor and the overall length of the aerosol-generating article substrate is preferably from about 0.22 to about 0.3, more preferably from about 0.24 to about 0.3, even more preferably from about 0.26 to about 0.3.

In a particularly preferred embodiment, a ratio between the length of the susceptor and the overall length of the aerosol-generating article substrate is about 0.27.

The susceptor preferably has a width from about 1 millimeters to about 5 millimeters.

The susceptor may generally have a thickness from about 0.01 millimeters to about 2 millimeters, for example from about 0.5 millimeters to about 2 millimeters. In some embodiments, the susceptor preferably has a thickness from about 10 micrometres to about 500 micrometres, more preferably from about 10 micrometres to about 100 micrometres.

If the susceptor has a constant cross-section, for example a circular cross-section, it has a preferable width or diameter from about 1 millimeter to about 5 millimeters.

If the susceptor has the form of a strip or blade, the strip or blade preferably has a rectangular shape having a width of preferably from about 2 millimeters to about 8 millimeters, more preferably from about 3 millimeters to about 5 millimeters. By way of example, a susceptor in the form of a strip of blade may have a width of about 4 millimeters.

If the susceptor has the form of a strip or blade, the strip or blade preferably has a rectangular shape and a thickness from about 0.03 millimeters to about 0.15 millimeters, more preferably from about 0.05 millimeters to about 0.09 millimeters. By way of example, a susceptor in the form of a strip of blade may have a thickness of about 0.07 millimeters.

In a preferred embodiment, the elongate susceptor (is in the form of a strip or blade, preferably has a rectangular shape, and) has a thickness from about 55 micrometres to about 65 micrometres.

More preferably, the elongate susceptor has a thickness from about 57 micrometres to about 63 micrometres. Even more preferably, the elongate susceptor has a thickness from about 58 micrometres to about 62 micrometres. In a particularly preferred embodiment, the elongate susceptor has a thickness of about 60 micrometres.

Without wishing to be bound by theory, the inventors consider that, as a whole, the selection of a given thickness for the susceptor is also impacted by constraints set by the selected length and width of the susceptor, as well as by constraints set by the geometry and dimensions of the rod of aerosol-generating substrate. By way of example, the length of the susceptor is preferably selected such as to match the length of the rod of aerosol-generating substrate. The width of the susceptor should preferably be chosen such that displacement of the susceptor within the substrate is prevented, whilst also enabling easy insertion during manufacturing.

The inventors have found that in an aerosol-generating article wherein a susceptor having a thickness within the range described above is provided for supplying heat inductively during use, it is advantageously possibly to generate and distribute heat throughout the aerosol-generating substrate in an especially effective and efficient way. Without wishing to be bound by theory, the inventors believe that this is because one such susceptor is adapted to provide optimal heat generation and heat transfer, by virtue of susceptor surface area and inductive power. By contrast, a thinner susceptor may be too easy to deform and may not maintain the desired shape and orientation within the rod of aerosol-generating substrate during manufacture of the aerosol-generating article, which may result in a less homogenous and less finely tuned heat distribution during use. At the same time, a thicker susceptor may be more difficult to cut to length with precision and consistency, and this may also impact how precisely the susceptor can be provided in longitudinal alignment within the rod of aerosol-generating substrate, thus also potentially impacting the homogeneity of heat distribution within the rod. These advantageous effects are felt especially when the susceptor extends all the way to the downstream end of the rod of aerosol-generating article. This is thought to be because the resistance to draw (RTD) downstream of the susceptor can thus basically be minimised, as there is no aerosol-generating substrate within the rod at a location downstream of the susceptor that can contribute to the RTD. This is achieved particularly effectively in some preferred embodiments, that will be described in more detail below, wherein the aerosol-generating article comprises a downstream section comprising a hollow intermediate section. One such hollow intermediate section does not substantially contribute to the overall RTD of the aerosol-generating article and does not directly contact a downstream end of the susceptor.

Without wishing to be bound by theory, the inventors consider that the most downstream portion of the rod of aerosol-generating substrate may act, to an extent, as a filter with respect to more upstream portions of the rod of aerosol-generating substrate. Thus, the inventors believe it is desirable to be able to heat homogeneously also the most downstream portion of the rod of aerosol-generating substrate, such that this is actively involved in the release of volatile aerosol species and contributes to the overall aerosol generation and delivery, and any possible filtration effect—which may hinder the delivery of aerosol to the consumer—is positively countered by the release of volatile aerosol species throughout the whole of the aerosol-generating substrate.

Preferably, the elongate susceptor has a length which is the same or shorter than the length of the aerosol-generating substrate. Preferably, the elongate susceptor has a same length as the aerosol-generating substrate.

The susceptor may be formed from any material that can be inductively heated to a temperature sufficient to generate an aerosol from the aerosol-generating substrate. Preferred susceptors comprise a metal or carbon.

A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength.

Thus, parameters of the susceptor such as material type, length, width, and thickness may all be altered to provide a desired power dissipation within a known electromagnetic field. Preferred susceptors may be heated to a temperature in excess of 250 degrees Celsius.

Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor is arranged in thermal contact with the aerosol-generating substrate. Thus, when the susceptor heats up the aerosol-generating substrate is heated up and an aerosol is formed. Preferably the susceptor is arranged in direct physical contact with the aerosol-generating substrate, for example within the aerosol-generating substrate.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500 degrees Celsius. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-generating substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-generating substrate and the temperature control of the heating may be separated. The first susceptor material is preferably a magnetic material having a Curie temperature that is above 500 degrees Celsius. It is desirable from the point of view of heating efficiency that the Curie temperature of the first susceptor material is above any maximum temperature that the susceptor should be capable of being heated to. The second Curie temperature may preferably be selected to be lower than 400 degrees Celsius, preferably lower than 380 degrees Celsius, or lower than 360 degrees Celsius. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-generating substrate. The second Curie temperature may, for example, be within the range of 200 degrees Celsius to 400 degrees Celsius, or between 250 degrees Celsius and 360 degrees Celsius. The second Curie temperature of the second susceptor material may, for example, be selected such that, upon being heated by a susceptor that is at a temperature equal to the second Curie temperature, an overall average temperature of the aerosol-generating substrate does not exceed 240 degrees Celsius.

As described briefly above, an aerosol-generating article in accordance with the invention further comprises a downstream section at a location downstream of the rod of aerosol-generating substrate. As will become apparent from the following description of different embodiments of the aerosol-generating article of the invention, the downstream section may comprise one or more downstream elements.

According to the invention, the downstream section of the aerosol-generating article comprises, in particular, a mouthpiece element positioned downstream of the rod of aerosol-generating substrate and in longitudinal alignment with the rod of aerosol-generating substrate.

The mouthpiece element is preferably located at the downstream end or mouth end of the aerosol-generating article, and extends all the way to the mouth end of the aerosol-generating article.

Preferably, the mouthpiece element comprises at least one mouthpiece filter segment of a fibrous filtration material for filtering the aerosol that is generated from the aerosol-generating substrate. Suitable fibrous filtration materials would be known to the skilled person. Particularly preferably, the at least one mouthpiece filter segment comprises a cellulose acetate filter segment formed of cellulose acetate tow.

In certain preferred embodiments, the mouthpiece element consists of a single mouthpiece filter segment. In alternative embodiments, the mouthpiece element includes two or more mouthpiece filter segments axially aligned in an abutting end to end relationship with each other.

In certain embodiments of the invention, the downstream section may comprise a mouth end cavity at the downstream end, downstream of the mouthpiece element as described above. The mouth end cavity may be defined by a hollow tubular element provided at the downstream end of the mouthpiece. Alternatively, the mouth end cavity may be defined by the outer wrapper of the mouthpiece element, wherein the outer wrapper extends in a downstream direction from the mouthpiece element.

The mouthpiece element may optionally comprise a flavourant, which may be provided in any suitable form. For example, the mouthpiece element may comprise one or more capsules, beads or granules of a flavourant, or one or more flavour loaded threads or filaments.

In an aerosol-generating article in accordance with the present invention the mouthpiece element forms a part of the downstream section and is therefore located downstream of the rod of aerosol-generating substrate.

In certain preferred embodiments, the downstream section of the aerosol-generating article further comprises a support element located immediately downstream of the rod of aerosol-generating substrate. The mouthpiece element is preferably located downstream of the support element. Preferably, the downstream section further comprises an aerosol-cooling element located immediately downstream of the support element. The mouthpiece element is preferably located downstream of both the support element and the aerosol-cooling element. Particularly preferably, the mouthpiece element is located immediately downstream of the aerosol-cooling element. By way of example, the mouthpiece element may abut the downstream end of the aerosol-cooling element.

Preferably, the mouthpiece element has a low particulate filtration efficiency.

Preferably, the mouthpiece is formed of a segment of a fibrous filtration material.

Preferably, the mouthpiece element is circumscribed by a plug wrap. Preferably, the mouthpiece element is unventilated such that air does not enter the aerosol-generating article along the mouthpiece element.

The mouthpiece element is preferably connected to one or more of the adjacent upstream components of the aerosol-generating article by means of a tipping wrapper. By way of example, the mouthpiece element may be connected to the immediately adjacent aerosol-cooling element by means of a band of tipping paper.

Preferably, the mouthpiece element has an RTD of less than about 25 millimeters $H_2O$. More preferably, the mouthpiece element has an RTD of less than about 20 millimeters $H_2O$. Even more preferably, the mouthpiece element has an RTD of less than about 15 millimeters $H_2O$.

Values of RTD from about 10 millimeters $H_2O$ to about to about 15 millimeters $H_2O$ are particularly preferred because a mouthpiece element having one such RTD is expected to contribute minimally to the overall RTD of the aerosol-generating article substantially does not exert a filtration action on the aerosol being delivered to the consumer.

The mouthpiece element preferably has an external diameter that is approximately equal to the external diameter of the aerosol-generating article. The mouthpiece element may have an external diameter of between about 5 millimeters and about 10 millimeters, or between about 6 millimeters and about 8 millimeters. In a preferred embodiment, the mouthpiece element has an external diameter of approximately 7.2 millimeters.

The mouthpiece element preferably has a length of at least about 5 millimeters, more preferably at least about 8 millimeters, more preferably at least about 10 millimeters. Alternatively or in addition, the mouthpiece element preferably has a length of less than about 25 millimeters, more preferably less than about 20 millimeters, more preferably less than about 15 millimeters.

In some embodiments, the mouthpiece element preferably has a length from about 5 millimeters to about 25 millimeters, more preferably from about 8 millimeters to about 25 millimeters, even more preferably from about 10 millimeters to about 25 millimeters. In other embodiments, the mouthpiece element preferably has a length from about 5 millimeters to about 10 millimeters, more preferably from about 8 millimeters to about 20 millimeters, even more preferably from about 10 millimeters to about 20 millimeters. In further embodiments, the mouthpiece element preferably has a length from about 5 millimeters to about 15 millimeters, more preferably from about 8 millimeters to about 15 millimeters, even more preferably from about 10 millimeters to about 15 millimeters.

For example, the mouthpiece element may have a length of between about 5 millimeters and about 25 millimeters, or between about 8 millimeters and about 20 millimeters, or between about 10 millimeters and about 15 millimeters. In a preferred embodiment, the mouthpiece element has a length of approximately 12 millimeters.

In certain preferred embodiments of the invention, the mouthpiece element has a length of at least 10 millimeters. In such embodiments, the mouthpiece element is therefore relatively long compared to the mouthpiece element provided in prior art articles. The provision of a relatively long mouthpiece element in the aerosol-generating articles of the present invention may provide several benefits to the consumer. The mouthpiece element is typically more resilient to deformation or better adapted to recover its initial shape after deformation than other elements that may be provided downstream of the rod of aerosol-generating substrate, such as an aerosol-cooling element or support element. Increasing the length of the mouthpiece element is therefore found to provide for improved grip by the consumer and to facilitate insertion of the aerosol-generating article into a heating device. A longer mouthpiece may additionally be used to provide a higher level of filtration and removal of undesirable aerosol constituents such as phenols, so that a higher quality aerosol can be delivered. In addition, the use of a longer mouthpiece element enables a more complex mouthpiece to be provided since there is more space for the incorporation of mouthpiece components such as capsules, threads and restrictors.

In particularly preferred embodiments of the invention, a mouthpiece having a length of at least 10 millimeters is combined with a relatively short aerosol-cooling element, for example, an aerosol-cooling element having a length of less than 10 millimeters. This combination has been found to provide a more rigid mouthpiece which reduces the risk of deformation of the aerosol-cooling element during use and to contribute to a more efficient puffing action by the consumer.

A ratio between the length of the mouthpiece element and the length of the rod of aerosol-generating substrate may be from about 0.5 to about 1.5.

Preferably, a ratio between the length of the mouthpiece element and the length of the rod of aerosol-generating substrate is at least about 0.6, more preferably at least about 0.7, even more preferably at least about 0.8. In preferred embodiments, a ratio between the length of the mouthpiece element and the length of the rod of aerosol-generating substrate is less than about 1.4, more preferably less than about 1.3, even more preferably less than about 1.2.

In some embodiments, a ratio between the length of the mouthpiece element and the length of the rod of aerosol-generating substrate is from about 0.6 to about 1.4, preferably from about 0.7 to about 1.4, more preferably from about 0.8 to about 1.4. In other embodiments, a ratio between the length of the mouthpiece element and the length of the rod of aerosol-generating substrate is from about 0.6 to about 1.3, preferably from about 0.7 to about 1.3, more preferably from about 0.8 to about 1.3. In further embodiments, a ratio between the length of the mouthpiece element and the length of the rod of aerosol-generating substrate is from about 0.6 to about 1.2, preferably from about 0.7 to about 1.2, more preferably from about 0.8 to about 1.2.

In a particularly preferred embodiments, a ratio between the length of the mouthpiece element and the length of the rod of aerosol-generating substrate is about 1.

A ratio between the length of the mouthpiece element and the overall length of the aerosol-generating article substrate may be from about 0.2 to about 0.35.

Preferably, a ratio between the length of the mouthpiece element and the overall length of the aerosol-generating article substrate is at least about 0.22, more preferably at least about 0.24, even more preferably at least about 0.26. A ratio between the length of the mouthpiece element and the overall length of the aerosol-generating article substrate is preferably less than about 0.34, more preferably less than about 0.32, even more preferably less than about 0.3.

In some embodiments, a ratio between the length of the mouthpiece element and the overall length of the aerosol-generating article substrate is preferably from about 0.22 to about 0.34, more preferably from about 0.24 to about 0.34, even more preferably from about 0.26 to about 0.34. In other embodiments, a ratio between the length of the mouthpiece element and the overall length of the aerosol-generating article substrate is preferably from about 0.22 to about 0.32, more preferably from about 0.24 to about 0.32, even more preferably from about 0.26 to about 0.32. In further embodiments, a ratio between the length of the mouthpiece element and the overall length of the aerosol-generating article substrate is preferably from about 0.22 to about 0.3, more preferably from about 0.24 to about 0.3, even more preferably from about 0.26 to about 0.3.

In a particularly preferred embodiment, a ratio between the length of the mouthpiece element and the overall length of the aerosol-generating article substrate is about 0.27.

The aerosol-generating article as a whole may have a length from about 35 millimeters to about 100 millimeters.

Preferably, an overall length of an aerosol-generating article in accordance with the invention is at least about 38 millimeters. More preferably, an overall length of an aerosol-generating article in accordance with the invention is at least about 40 millimeters. Even more preferably, an overall length of an aerosol-generating article in accordance with the invention is at least about 42 millimeters.

An overall length of an aerosol-generating article in accordance with the invention is preferably less than or equal to 70 millimeters. More preferably, an overall length of an aerosol-generating article in accordance with the invention is preferably less than or equal to 60 millimeters. Even more preferably, an overall length of an aerosol-generating article in accordance with the invention is preferably less than or equal to 50 millimeters.

In some embodiments, an overall length of the aerosol-generating article is preferably from about 38 millimeters to about 70 millimeters, more preferably from about 40 millimeters to about 70 millimeters, even more preferably from about 42 millimeters to about 70 millimeters. In other embodiments, an overall length of the aerosol-generating article is preferably from about 38 millimeters to about 60 millimeters, more preferably from about 40 millimeters to about 60 millimeters, even more preferably from about 42 millimeters to about 60 millimeters. In further embodiments, an overall length of the aerosol-generating article is preferably from about 38 millimeters to about 50 millimeters, more preferably from about 40 millimeters to about 50 millimeters, even more preferably from about 42 millimeters to about 50 millimeters. In an exemplary embodiment, an overall length of the aerosol-generating article is about 45 millimeters.

The aerosol-generating article has an external diameter of at least 5 millimeters. Preferably, the aerosol-generating article has an external diameter of at least 6 millimeters. More preferably, the aerosol-generating article has an external diameter of at least 7 millimeters.

Preferably, the aerosol-generating article has an external diameter of less than or equal to about 12 millimeters. More preferably, the aerosol-generating article has an external diameter of less than or equal to about 10 millimeters. Even more preferably, the aerosol-generating article has an external diameter of less than or equal to about 8 millimeters.

In some embodiments, the aerosol-generating article has an external diameter from about 5 millimeters to about 12 millimeters, preferably from about 6 millimeters to about 12 millimeters, more preferably from about 7 millimeters to about 12 millimeters. In other embodiments, the aerosol-generating article has an external diameter from about 5 millimeters to about 10 millimeters, preferably from about 6 millimeters to about 10 millimeters, more preferably from about 7 millimeters to about 10 millimeters. In further embodiments, the aerosol-generating article has an external diameter from about 5 millimeters to about 8 millimeters, preferably from about 6 millimeters to about 8 millimeters, more preferably from about 7 millimeters to about 8 millimeters.

In accordance with the present invention, a diameter ($D_{ME}$) of the aerosol-generating article at the mouth end is greater than a diameter ($D_{DE}$) of the aerosol-generating article at the distal end, a ratio ($D_{ME}/D_{DE}$) between the diameter of the aerosol-generating article at the mouth end and the diameter of the aerosol-generating article at the distal end being at least about 1.005.

Preferably, a ratio ($D_{ME}/D_{DE}$) between the diameter of the aerosol-generating article at the mouth end and the diameter of the aerosol-generating article at the distal end is (preferably) at least about 1.01. More preferably, a ratio ($D_{ME}/D_{DE}$) between the diameter of the aerosol-generating article at the mouth end and the diameter of the aerosol-generating article at the distal end is at least about 1.02. Even more preferably, a ratio ($D_{ME}/D_{DE}$) between the diameter of the aerosol-generating article at the mouth end and the diameter of the aerosol-generating article at the distal end is at least about 1.05.

A ratio ($D_{ME}/D_{DE}$) between the diameter of the aerosol-generating article at the mouth end and the diameter of the aerosol-generating article at the distal end is preferably less than or equal to about 1.30. More preferably, a ratio ($D_{ME}/D_{DE}$) between the diameter of the aerosol-generating article at the mouth end and the diameter of the aerosol-generating article at the distal end is less than or equal to about 1.25. Even more preferably, a ratio ($D_{ME}/D_{DE}$) between the diameter of the aerosol-generating article at the mouth end and the diameter of the aerosol-generating article at the distal end is less than or equal to about 1.20. In particularly preferred embodiments, a ratio ($D_{ME}/D_{DE}$) between the diameter of the aerosol-generating article at the mouth end and the diameter of the aerosol-generating article at the distal end is less than or equal to 1.15 or 1.10.

In some preferred embodiments, a ratio ($D_{ME}/D_{DE}$) between the diameter of the aerosol-generating article at the mouth end and the diameter of the aerosol-generating article at the distal end is from about 1.01 to 1.30, more preferably from 1.02 to 1.30, even more preferably from 1.05 to 1.30.

In other embodiments, a ratio ($D_{ME}/D_{DE}$) between the diameter of the aerosol-generating article at the mouth end and the diameter of the aerosol-generating article at the distal end is from about 1.01 to 1.25, more preferably from 1.02 to 1.25, even more preferably from 1.05 to 1.25. In further embodiments, a ratio ($D_{ME}/D_{DE}$) between the diameter of the aerosol-generating article at the mouth end and the diameter of the aerosol-generating article at the distal end is from about 1.01 to 1.20, more preferably from 1.02 to 1.20, even more preferably from 1.05 to 1.20. In yet further embodiments, a ratio ($D_{ME}/D_{DE}$) between the diameter of the aerosol-generating article at the mouth end and the diameter of the aerosol-generating article at the distal end is from about 1.01 to 1.15, more preferably from 1.02 to 1.15, even more preferably from 1.05 to 1.15.

A difference between the diameter ($D_{ME}$) of the aerosol-generating article at the mouth end and the diameter ($D_{DE}$) of the aerosol-generating article at the distal end may be at least about 25 micrometres. Preferably, a difference between the diameter ($D_{ME}$) of the aerosol-generating article at the mouth end and the diameter ($D_{DE}$) of the aerosol-generating article at the distal end is at least about 50 micrometres. More preferably, a difference between the diameter ($D_{ME}$) of the aerosol-generating article at the mouth end and the diameter ($D_{DE}$) of the aerosol-generating article at the distal end is at least about 100 micrometres. Even more preferably, a difference between the diameter ($D_{ME}$) of the aerosol-generating article at the mouth end and the diameter ($D_{DE}$) of the aerosol-generating article at the distal end is at least about 150 micrometres. In particularly preferred embodiments, a difference between the diameter ($D_{ME}$) of the aerosol-generating article at the mouth end and the diameter ($D_{DE}$) of the aerosol-generating article at the distal end is at least about 200 micrometres, more preferably at least about 300 micrometres, even more preferably at least about 500 micrometres.

Without wishing to be bound by theory, it is expected that one such difference between the diameter ($D_{ME}$) of the aerosol-generating article at the mouth end and the diameter ($D_{DE}$) of the aerosol-generating article at the distal end is sufficient for establishing an interference between the mouth end of the aerosol-generating article and the access opening of cavity of a heating device adapted to receive the aerosol-generating article during use, whilst at the same time ensuring that the distal end of the aerosol-generating article can easily and swiftly be received within the cavity.

By way of example, the external diameter of the article may be substantially constant over a distal portion of the article extending from the distal end of the aerosol-generating article for at least about 5 millimeters or at least about 10 millimeters. As an alternative, the external diameter of the article may taper over a distal portion of the article extending from the distal end for at least about 5 millimeters or at least about 10 millimeters.

As described briefly above, in some preferred embodiments the mouthpiece element is affixed to one or more of the adjacent upstream components of the aerosol-generating article by means of a tipping wrapper. By way of example, the mouthpiece element may be connected to the immediately adjacent aerosol-cooling element by means of a band of tipping paper.

In certain embodiments, the aerosol-generating article comprises a first band of tipping paper at least partially circumscribing the mouthpiece element and affixing the mouthpiece to an immediately adjacent, upstream component of the aerosol-generating article, and a second band of tipping paper circumscribing the first band of tipping paper. This may provide an effective and relatively convenient way of ensuring that the mouth end and the distal end of the aerosol-generating articles have different diameters in accordance with the invention, since the combined thickness of the two or more bands of tipping paper effectively contributes to the diameter ($D_{ME}$) of the aerosol-generating article at the mouth end.

In some of these embodiments, the mouthpiece element is at least partially circumscribed by two or more bands of tipping paper, while the upstream element at the distal end of the aerosol-generating article is not circumscribed by tipping paper. This may advantageously help maximise a difference between the diameter ($D_{ME}$) of the aerosol-generating article at the mouth end and the diameter ($D_{DE}$) of the aerosol-generating article at the distal end.

In other ones of these embodiments, the mouthpiece element is at least partially circumscribed by two or more bands of tipping paper, while the upstream element at the distal end of the aerosol-generating article is circumscribed by a single band of tipping paper. This may help control how weight is distributed along a length of the aerosol-generating article.

In some embodiments, the downstream section may comprise an intermediate hollow section between the mouthpiece element and the rod of aerosol-generating substrate. The intermediate hollow section may comprise one or more of a support element and an aerosol-cooling element. One or more of the support element and the aerosol-cooling element may comprise a hollow tubular segment. In such embodiments, the one or more of the support element and the aerosol-cooling element comprising one or more hollow tubular segments may thus form an intermediate hollow section of the aerosol-generating article.

As used herein, the term "hollow tubular segment" is used to denote a generally elongate element defining a lumen or airflow passage along a longitudinal axis thereof. In particular, the term "tubular" will be used in the following with reference to a tubular element having a substantially cylindrical cross-section and defining at least one airflow conduit establishing an uninterrupted fluid communication between an upstream end of the tubular element and a downstream end of the tubular element. However, it will be understood that alternative geometries (for example, alternative cross-sectional shapes) of the tubular element may be possible.

In the context of the present invention a hollow tubular segment provides an unrestricted flow channel. This means that the hollow tubular segment provides a negligible level of resistance to draw (RTD). The flow channel should therefore be free from any components that would obstruct the flow of air in a longitudinal direction. Preferably, the flow channel is substantially empty.

When used for describing an aerosol-cooling element or support element or another component of the downstream section, the term "elongate" means that the aerosol-cooling element or support element or other component of the downstream section has a length dimension that is greater than its width dimension or its diameter dimension, for example twice or more its width dimension or its diameter dimension.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. Other suitable materials include polyhydroxyalkanoate (PHA) fibres.

The support element may comprise a first hollow tubular segment. In a preferred embodiment, the support element comprises a hollow cellulose acetate tube.

The support element is arranged substantially in alignment with the rod. This means that the length dimension of the support element is arranged to be approximately parallel to the longitudinal direction of the rod and of the article, for example within plus or minus 10 degrees of parallel to the longitudinal direction of the rod. In preferred embodiments, the support element extends along the longitudinal axis of the rod.

The support element preferably has an outer diameter that is approximately equal to the outer diameter of the rod of aerosol-generating substrate and to the outer diameter of the aerosol-generating article.

The support element may have an outer diameter of between 5 millimeters and 12 millimeters, for example of between 5 millimeters and 10 millimeters or of between 6 millimeters and 8 millimeters. In a preferred embodiment, the support element has an external diameter of 7.2 millimeters plus or minus 10 percent.

A peripheral wall of the support element may have a thickness of at least 1 millimeter, preferably at least about 1.5 millimeters, more preferably at least about 2 millimeters.

The support element may have a length of between about 5 millimeters and about 15 millimeters.

Preferably, the support element has a length of at least about 6 millimeters, more preferably at least about 7 millimeters.

In preferred embodiments, the support element has a length of less than about 12 millimeters, more preferably less than about 10 millimeters.

In some embodiments, the support element has a length from about 5 millimeters to about 15 millimeters, preferably from about 6 millimeters to about 15 millimeters, more preferably from about 7 millimeters to about 15 millimeters. In other embodiments, the support element has a length from about 5 millimeters to about 12 millimeters, preferably from about 6 millimeters to about 12 millimeters, more preferably from about 7 millimeters to about 12 millimeters. In further embodiments, the support element has a length from about 5 millimeters to about 10 millimeters, preferably from about 6 millimeters to about 10 millimeters, more preferably from about 7 millimeters to about 10 millimeters.

In a preferred embodiment, the support element has a length of about 8 millimeters.

Preferably, the total length of the intermediate hollow section is no more than about 18 millimeters, more preferably no more than about 17 millimeters, more preferably no more than 16 millimeters.

A ratio between the length of the support element and the length of the rod of aerosol-generating substrate may be from about 0.25 to about 1.

Preferably, a ratio between the length of the support element and the length of the rod of aerosol-generating substrate is at least about 0.3, more preferably at least about 0.4, even more preferably at least about 0.5. In preferred embodiments, a ratio between the length of the support element and the length of the rod of aerosol-generating substrate is less than about 0.9, more preferably less than about 0.8, even more preferably less than about 0.7.

In some embodiments, a ratio between the length of the support element and the length of the rod of aerosol-generating substrate is from about 0.3 to about 0.9, preferably from about 0.4 to about 0.9, more preferably from about 0.5 to about 0.9. In other embodiments, a ratio between the length of the support element and the length of the rod of aerosol-generating substrate is from about 0.3 to about 0.8, preferably from about 0.4 to about 0.8, more preferably from about 0.5 to about 0.8. In further embodiments, a ratio between the length of the support element and the length of the rod of aerosol-generating substrate is from about 0.3 to about 0.7, preferably from about 0.4 to about 0.7, more preferably from about 0.5 to about 0.7.

In a particularly preferred embodiments, a ratio between the length of the support element and the length of the rod of aerosol-generating substrate is about 0.66.

A ratio between the length of the support element and the overall length of the aerosol-generating article substrate may be from about 0.125 to about 0.375.

Preferably, a ratio between the length of the support element and the overall length of the aerosol-generating article substrate is at least about 0.13, more preferably at least about 0.14, even more preferably at least about 0.15. A ratio between the length of the support element and the overall length of the aerosol-generating article substrate is preferably less than about 0.3, more preferably less than about 0.25, even more preferably less than about 0.20.

In some embodiments, a ratio between the length of the support element and the overall length of the aerosol-generating article substrate is preferably from about 0.13 to about 0.3, more preferably from about 0.14 to about 0.3, even more preferably from about 0.15 to about 0.3. In other embodiments, a ratio between the length of the support element and the overall length of the aerosol-generating article substrate is preferably from about 0.13 to about 0.25, more preferably from about 0.14 to about 0.25, even more preferably from about 0.15 to about 0.25. In further embodiments, a ratio between the length of the support element and the overall length of the aerosol-generating article substrate is preferably from about 0.13 to about 0.2, more preferably from about 0.14 to about 0.2, even more preferably from about 0.15 to about 0.2.

In a particularly preferred embodiment, a ratio between the length of the support element and the overall length of the aerosol-generating article substrate is about 0.18.

Preferably, in aerosol-generating articles in accordance with the present invention the support element has an average radial hardness of at least about 80 percent, more preferably at least about 85 percent, even more preferably at least about 90 percent. The support element is therefore able to provide a desirable level of hardness to the aerosol-generating article.

If desired, the radial hardness of a component, such as the support element, of the downstream section of aerosol-generating articles in accordance with the invention may be further increased by circumscribing the aerosol-cooling element by a stiff plug wrap, for example, a plug wrap having a basis weight of at least about 80 grams per square metre (gsm), or at least about 100 gsm, or at least about 110 gsm.

As used herein, the term "radial hardness" refers to resistance to compression in a direction transverse to a longitudinal axis of the support element. Radial hardness of an aerosol-generating article around a support element may be determined by applying a load across the article at the location of the support element, transverse to the longitudinal axis of the article, and measuring the average (mean) depressed diameters of the articles. Radial hardness is given by:

$$\text{Radial hardness } (\%) = \frac{D_d}{D_S} * 100\,\%$$

where $D_S$ is the original (undepressed) diameter, and $D_d$ is the depressed diameter after applying a set load for a set duration. The harder the material, the closer the hardness is to 100 percent.

To determine the hardness of a portion (such as a support element provided in the form of a hollow tube segment) of an aerosol article, aerosol-generating articles should be aligned parallel in a plane and the same portion of each aerosol-generating article to be tested should be subjected to a set load for a set duration. This test is performed using a known DD60A Densimeter device (manufactured and made commercially available by Heinr Borgwaldt GmbH, Germany), which is fitted with a measuring head for aerosol-generating articles, such as cigarettes, and with an aerosol-generating article receptacle.

The load is applied using two load-applying cylindrical rods, which extend across the diameter of all of the aerosol-generating articles at once. According to the standard test method for this instrument, the test should be performed such that twenty contact points occur between the aerosol-generating articles and the load applying cylindrical rods. In some cases, the hollow tube segments to be tested may be long enough such that only ten aerosol-generating articles are needed to form twenty contact points, with each smoking article contacting both load applying rods (because they are long enough to extend between the rods). In other cases, if the support elements are too short to achieve this, then twenty aerosol-generating articles should be used to form the twenty contact points, with each aerosol-generating article contacting only one of the load applying rods, as further discussed below.

Two further stationary cylindrical rods are located underneath the aerosol-generating articles, to support the aerosol-generating articles and counteract the load applied by each of the load applying cylindrical rods.

For the standard operating procedure for such an apparatus, an overall load of 2 kg is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Celsius±2 degrees. The test described above is referred to as the DD60A Test. The standard way to measure the filter hardness is when the aerosol-generating article have not been consumed. Additional information regarding measurement of average radial hardness can be found in, for example, U.S. Published Patent Application Publication Number 2016/0128378.

During insertion of an aerosol-generating article in accordance with the invention into an aerosol-generating device for heating the aerosol-generating substrate, a user may be required to apply some force in order to overcome the resistance of the aerosol-generating substrate of the aerosol-generating article to insertion. This may damage one or both of the aerosol-generating article and the aerosol-generating device. In addition, the application of force during insertion of the aerosol-generating article into the aerosol-generating device may displace the aerosol-generating substrate within the aerosol-generating article. This may result in the heating element of the aerosol-generating device not being properly aligned with the susceptor provided within the aerosol-generating substrate, which may lead to uneven and inefficient heating of the aerosol-generating substrate of the aerosol-generating article. The support element is advantageously configured to resist downstream movement of the aerosol-generating substrate during insertion of the article into the aerosol-generating device.

Preferably, the hollow tubular segment of the support element is adapted to generate a RTD between approximately 0 millimeters $H_2O$ (about 0 Pa) to approximately 20 millimeters $H_2O$ (about 100 Pa), more preferably between approximately 0 millimeters $H_2O$ (about 0 Pa) to approximately 10 millimeters $H_2O$ (about 100 Pa). The support element therefore preferably does not contribute to the overall RTD of the aerosol-generating article.

The aerosol-cooling element of the downstream section of aerosol-generating articles in accordance with the present invention is preferably in the form of a second hollow tubular segment that defines a cavity extending all the way from an upstream end of the aerosol-cooling element to a downstream end of the aerosol-cooling element and a ventilation zone is provided at a location along the hollow tubular segment.

The inventors have found that a satisfactory cooling of the stream of aerosol generated upon heating the aerosol-generating substrate and drawn through one such aerosol-cooling element is achieved by providing a ventilation zone at a location along the hollow tubular segment. Further, the inventors have found that, as will be described in more detail below, by arranging the ventilation zone at a precisely defined location along the length of the aerosol-cooling element and by preferably utilising a hollow tubular segment having a predetermined peripheral wall thickness or internal volume, it may be possible to counter the effects of the increased aerosol dilution caused by the admission of ventilation air into the article.

Without wishing to be bound by theory, it is hypothesised that, because the temperature of the aerosol stream is rapidly lowered by the introduction of ventilation air as the aerosol is travelling towards the mouthpiece segment, the ventilation air being admitted into the aerosol stream at a location relatively close to the upstream end of the aerosol-cooling element (that is, sufficiently close to the susceptor extending within the rod of aerosol-generating substrate, which is the heat source during use), a dramatic cooling of the aerosol stream is achieved, which has a favourable impact on the condensation and nucleation of the aerosol particles. Accordingly, the overall proportion of the aerosol particulate phase to the aerosol gas phase may be enhanced compared with existing, non-ventilated aerosol-generating articles.

At the same time, keeping the thickness of the peripheral wall of the hollow tubular element relatively low ensures that the overall internal volume of the hollow tubular element—which is made available for the aerosol to begin the nucleation process as soon as the aerosol components leave the rod of aerosol-generating substrate—and the cross-sectional surface area of the hollow tubular segment are effectively maximised, whilst at the same time ensuring that the hollow tubular segment has the necessary structural strength to prevent a collapse of the aerosol-generating article as well as to provide some support to the rod of aerosol-generating substrate, and that the RTD of the hollow tubular segment is minimised. Greater values of cross-sectional surface area of the cavity of the hollow tubular segment are understood to be associated with a reduced speed of the aerosol stream travelling along the aerosol-generating article, which is also expected to favour aerosol nucleation. Further, it would appear that by utilising a hollow tubular segment having a relatively low thickness, it is possible to substantially prevent diffusion of the ventilation air prior to its contacting and mixing with the stream of aerosol, which is also understood to further favour nucleation phenomena. In practice, by providing a more controllably localised cooling of the stream of volatilised species, it is possible to enhance the effect of cooling on the formation of new aerosol particles.

The aerosol-cooling element preferably has an outer diameter that is approximately equal to the outer diameter of the rod of aerosol-generating substrate and to the outer diameter of the aerosol-generating article.

The aerosol-cooling element may have an outer diameter of between 5 millimeters and 12 millimeters, for example of between 5 millimeters and 10 millimeters or of between 6 millimeters and 8 millimeters. In a preferred embodiment, the aerosol-cooling element has an external diameter of 7.2 millimeters plus or minus 10 percent.

Preferably, the second hollow tubular segment of the aerosol-cooling element has an internal diameter of at least about 1.5 millimeters. More preferably, the second hollow tubular segment of the aerosol-cooling element has an internal diameter of at least about 2 millimeters. Even more preferably, the second hollow tubular segment of the aerosol-cooling element has an internal diameter of at least about 2.5 millimeters. In particularly preferred embodiments, the second hollow tubular segment of the aerosol-cooling element has an internal diameter of at least about 3 millimeters.

A peripheral wall of the second hollow tubular segment of the aerosol-cooling element may have a thickness of less than about 2.5 millimeters, preferably less than about 1.5 millimeters, more preferably less than about 1250 micrometres, even more preferably less than about 1000 micrometres. In particularly preferred embodiments, the peripheral wall of the second hollow tubular segment of the aerosol-cooling element has a thickness of less than about 900 micrometres, preferably less than about 800 micrometres.

In an embodiment, a peripheral wall of the second hollow tubular segment of the aerosol-cooling element has a thickness of about 2 millimeters.

The aerosol-cooling element may have a length of between 5 millimeters and 15 millimeters.

Preferably, the aerosol-cooling element has a length of at least about 6 millimeters, more preferably at least about 7 millimeters.

In preferred embodiments, the aerosol-cooling element has a length of less than about 12 millimeters, more preferably less than about 10 millimeters.

In some embodiments, the aerosol-cooling element has a length from about 5 millimeters to about 15 millimeters, preferably from about 6 millimeters to about 15 millimeters, more preferably from about 7 millimeters to about 15 millimeters. In other embodiments, the aerosol-cooling element has a length from about 5 millimeters to about 12 millimeters, preferably from about 6 millimeters to about 12 millimeters, more preferably from about 7 millimeters to about 12 millimeters. In further embodiments, the aerosol-cooling element has a length from about 5 millimeters to about 10 millimeters, preferably from about 6 millimeters to about 10 millimeters, more preferably from about 7 millimeters to about 10 millimeters.

In particularly preferred embodiments of the invention, the aerosol-cooling element has a length of less than 10 millimeters. For example, in one particularly preferred embodiment, the aerosol-cooling element has a length of 8 millimeters. In such embodiments, the aerosol-cooling element therefore has a relatively short length compared to the aerosol-cooling elements of prior art aerosol-generating articles. A reduction in the length of the aerosol-cooling element is possible due to the optimised effectiveness of the hollow tubular segment forming the aerosol-cooling element in the cooling and nucleation of the aerosol. The reduction of the length of the aerosol-cooling element advantageously reduces the risk of deformation of the aerosol-generating article due to compression during use, since the aerosol-cooling element typically has a lower resistance to deformation than the mouthpiece. Furthermore, the reduction of the length of the aerosol-cooling element may provide a cost benefit to the manufacturer since the cost of a hollow tubular segment is typically higher per unit length than the cost of other elements such as a mouthpiece element.

A ratio between the length of the aerosol-cooling element and the length of the rod of aerosol-generating substrate may be from about 0.25 to about 1.

Preferably, a ratio between the length of the aerosol-cooling element and the length of the rod of aerosol-generating substrate is at least about 0.3, more preferably at least about 0.4, even more preferably at least about 0.5. In preferred embodiments, a ratio between the length of the aerosol-cooling element and the length of the rod of aerosol-generating substrate is less than about 0.9, more preferably less than about 0.8, even more preferably less than about 0.7.

In some embodiments, a ratio between the length of the aerosol-cooling element and the length of the rod of aerosol-generating substrate is from about 0.3 to about 0.9, preferably from about 0.4 to about 0.9, more preferably from about 0.5 to about 0.9. In other embodiments, a ratio between the length of the aerosol-cooling element and the length of the rod of aerosol-generating substrate is from about 0.3 to about 0.8, preferably from about 0.4 to about 0.8, more preferably from about 0.5 to about 0.8. In further embodiments, a ratio between the length of the aerosol-cooling element and the length of the rod of aerosol-generating substrate is from about 0.3 to about 0.7, preferably from about 0.4 to about 0.7, more preferably from about 0.5 to about 0.7.

In a particularly preferred embodiments, a ratio between the length of the aerosol-cooling element and the length of the rod of aerosol-generating substrate is about 0.66.

A ratio between the length of the aerosol-cooling element and the overall length of the aerosol-generating article substrate may be from about 0.125 to about 0.375.

Preferably, a ratio between the length of the aerosol-cooling element and the overall length of the aerosol-generating article substrate is at least about 0.13, more preferably at least about 0.14, even more preferably at least about 0.15. A ratio between the length of the aerosol-cooling element and the overall length of the aerosol-generating article substrate is preferably less than about 0.3, more preferably less than about 0.25, even more preferably less than about 0.20.

In some embodiments, a ratio between the length of the aerosol-cooling element and the overall length of the aerosol-generating article substrate is preferably from about 0.13 to about 0.3, more preferably from about 0.14 to about 0.3, even more preferably from about 0.15 to about 0.3. In other embodiments, a ratio between the length of the aerosol-cooling element and the overall length of the aerosol-generating article substrate is preferably from about 0.13 to about 0.25, more preferably from about 0.14 to about 0.25, even more preferably from about 0.15 to about 0.25. In further embodiments, a ratio between the length of the aerosol-cooling element and the overall length of the aerosol-generating article substrate is preferably from about 0.13 to about 0.2, more preferably from about 0.14 to about 0.2, even more preferably from about 0.15 to about 0.2.

In a particularly preferred embodiment, a ratio between the length of the aerosol-cooling element and the overall length of the aerosol-generating article substrate is about 0.18.

Preferably, the length of the mouthpiece element is at least 1 millimeter greater than the length of the aerosol-cooling element, more preferably at least 2 millimeters greater than the length of the aerosol-cooling element, more preferably at least 3 millimeters greater than the length of the aerosol-cooling element. A reduction in the length of the aerosol-cooling element, as described above, can advantageously allow for an increase in the length of other elements of the aerosol-generating article, such as the mouthpiece element. The potential technical benefits of providing a relatively long mouthpiece element are described above.

Preferably, in aerosol-generating articles in accordance with the present invention the aerosol-cooling element has an average radial hardness of at least about 80 percent, more preferably at least about 85 percent, even more preferably at least about 90 percent. The aerosol-cooling element is therefore able to provide a desirable level of hardness to the aerosol-generating article.

If desired, the radial hardness of the aerosol-cooling element of aerosol-generating articles in accordance with the invention may be further increased by circumscribing the aerosol-cooling element by a stiff plug wrap, for example, a plug wrap having a basis weight of at least about 80 grams per square metre (gsm), or at least about 100 gsm, or at least about 110 gsm.

The aerosol-cooling element may be formed from any suitable material or combination of materials. For example, the aerosol-cooling element may be formed from one or more materials selected from the group consisting of: cellulose acetate; cardboard; crimped paper, such as crimped heat resistant paper or crimped parchment paper; and polymeric materials, such as low density polyethylene (LDPE). Other suitable materials include polyhydroxyalkanoate (PHA) fibres.

In a preferred embodiment, the aerosol-cooling element is formed from cellulose acetate.

The ventilation zone comprises a plurality of perforations through the peripheral wall of the aerosol-cooling element. Preferably, the ventilation zone comprises at least one circumferential row of perforations. In some embodiments, the ventilation zone may comprise two circumferential rows of perforations. For example, the perforations may be formed online during manufacturing of the aerosol-generating article. Preferably, each circumferential row of perforations comprises from 8 to 30 perforations.

Where the aerosol-generating article comprises a combining plug for affixing the aerosol-cooling element to one or more of the other components of the aerosol-generating article, the ventilation zone preferably comprises at least one corresponding circumferential row of perforations provided through a portion of the combining plug wrap. These may also be formed online during manufacture of the smoking article. Preferably, the circumferential row or rows of perforations provided through a portion of the combining plug wrap are in substantial alignment with the row or rows of perforations through the peripheral wall of the aerosol-cooling element.

Where the aerosol-generating article comprises a band of tipping paper for affixing the aerosol-cooling element to a mouthpiece element of the aerosol-generating article, wherein the band of tipping paper extends over the circumferential row or rows of perforations in the peripheral wall of the aerosol-cooling element, the ventilation zone preferably comprises at least one corresponding circumferential row of perforations provided through the band of tipping paper. These may also be formed online during manufacture of the smoking article. Preferably, the circumferential row or rows of perforations provided through the band of tipping paper are in substantial alignment with the row or rows of perforations through the peripheral wall of the aerosol-cooling element.

In some embodiments, a distance between the ventilation zone and an upstream end of the hollow tubular segment of the aerosol-cooling element is at least about 1 millimeter. Preferably, a distance between the ventilation zone and an upstream end of the hollow tubular segment of the aerosol-cooling element is at least about 2 millimeters. More preferably, a distance between the ventilation zone and an upstream end of the hollow tubular segment of the aerosol-cooling element is at least about 3 millimeters.

In some embodiments, a distance between the ventilation zone and an upstream end of the hollow tubular segment of the aerosol-cooling element is less than or equal to about 6 millimeters. Preferably, a distance between the ventilation zone and an upstream end of the hollow tubular segment of the aerosol-cooling element is less than or equal to about 5 millimeters. More preferably, a distance between the ventilation zone and an upstream end of the hollow tubular segment of the aerosol-cooling element is less than or equal to about 4 millimeters.

In some embodiments, a distance between the ventilation zone and an upstream end of the hollow tubular segment of the aerosol-cooling element is from about 1 millimeter to about 6 millimeters, preferably from about 1 millimeter to about 5 millimeters, more preferably from about 1 millimeter to about 4 millimeters. In other embodiments, a distance between the ventilation zone and an upstream end of the hollow tubular segment of the aerosol-cooling element is from about 2 millimeters to about 6 millimeters, preferably from about 2 millimeters to about 5 millimeters, more preferably from about 2 millimeters to about 4 millimeters. In further embodiments, a distance between the ventilation zone and an upstream end of the hollow tubular segment of the aerosol-cooling element is from about 3 millimeters to about 6 millimeters, preferably from about 3 millimeters to about 5 millimeters, more preferably from about 3 millimeters to about 4 millimeters.

A distance between the ventilation zone and a mouth end of the aerosol-generating article is preferably at least about 10 millimeters. More preferably, a distance between the ventilation zone and a mouth end of the aerosol-generating article is at least about 12 millimeters. Even more preferably, a distance between the ventilation zone and a mouth end of the aerosol-generating article is at least about 16 millimeters.

A distance between the ventilation zone and a mouth end of the aerosol-generating article is preferably less than or equal to about 26 millimeters. More preferably, a distance between the ventilation zone and a mouth end of the aerosol-generating article is less than or equal to about 24 millimeters. Even more preferably, a distance between the ventilation zone and a mouth end of the aerosol-generating article is less than or equal to about 22 millimeters. In particularly preferred embodiments, a distance between the ventilation zone and a mouth end of the aerosol-generating article is less than or equal to about 20 millimeters.

In some embodiments, a distance between the ventilation zone and a mouth end of the aerosol-generating article is from about 10 millimeters to about 26 millimeters, preferably from about 10 millimeters to about 24 millimeters, more preferably from about 10 millimeters to about 22 millimeters, even more preferably from about 10 millimeters to about 20 millimeters. In other embodiments, a distance between the ventilation zone and a mouth end of the aerosol-generating article is from about 12 millimeters to about 26 millimeters, preferably from about 12 millimeters to about 24 millimeters, more preferably from about 12 millimeters to about 22 millimeters, even more preferably from about 12 millimeters to about 20 millimeters. In further embodiments, a distance between the ventilation zone and a mouth end of the aerosol-generating article is from about 14 millimeters to about 26 millimeters, preferably from about 14 millimeters to about 24 millimeters, more preferably from about 14 millimeters to about 22 millimeters, even more preferably from about 14 millimeters to about 20 millimeters. In yet further embodiments, a distance between the ventilation zone and a mouth end of the aerosol-generating article is from about 16 millimeters to about 26 millimeters, preferably from about 16 millimeters to about 24 millimeters, more preferably from about 16 millimeters to about 22 millimeters, even more preferably from about 16 millimeters to about 20 millimeters.

A distance between the ventilation zone and an upstream end of the downstream section is preferably at least about 6 millimeters. More preferably, a distance between the ventilation zone and an upstream end of the downstream section is at least about 8 millimeters. Even more preferably, a distance between the ventilation zone and an upstream end of the downstream section is at least about 10 millimeters.

A distance between the ventilation zone and an upstream end of the downstream section is preferably less than or equal to about 20 millimeters. More preferably, a distance between the ventilation zone and an upstream end of the downstream section is less than or equal to about 18 millimeters. Even more preferably, a distance between the ventilation zone and an upstream end of the downstream section is less than or equal to about 16 millimeters.

In some embodiments, a distance between the ventilation zone and an upstream end of the downstream section is preferably from about 6 millimeters to about 20 millimeters, more preferably from about 8 millimeters to about 20 millimeters, even more preferably from about 10 millimeters to about 20 millimeters. In other embodiments, a distance between the ventilation zone and an upstream end of the downstream section is preferably from about 6 millimeters to about 18 millimeters, more preferably from about 8 millimeters to about 18 millimeters, even more preferably from about 10 millimeters to about 18 millimeters. In further embodiments, a distance between the ventilation zone and an upstream end of the downstream section is preferably from about 6 millimeters to about 16 millimeters, more preferably from about 8 millimeters to about 16 millimeters, even more preferably from about 10 millimeters to about 16 millimeters.

A distance between the ventilation zone and a downstream end of the susceptor is preferably at least about 6 millimeters. More preferably, a distance between the ventilation zone and a downstream end of the susceptor is at least about 8 millimeters. Even more preferably, a distance between the ventilation zone and a downstream end of the susceptor is at least about 10 millimeters.

A distance between the ventilation zone and a downstream end of the susceptor is preferably less than or equal to about 20 millimeters. More preferably, a distance between the ventilation zone and a downstream end of the susceptor is less than or equal to about 18 millimeters. Even more preferably, a distance between the ventilation zone and a downstream end of the susceptor is less than or equal to about 16 millimeters.

In some embodiments, a distance between the ventilation zone and a downstream end of the susceptor is preferably from about 6 millimeters to about 20 millimeters, more preferably from about 8 millimeters to about 20 millimeters, even more preferably from about 10 millimeters to about 20 millimeters. In other embodiments, a distance between the ventilation zone and a downstream end of the susceptor is preferably from about 6 millimeters to about 18 millimeters, more preferably from about 8 millimeters to about 18 millimeters, even more preferably from about 10 millimeters to about 18 millimeters. In further embodiments, a distance between the ventilation zone and a downstream end of the susceptor is preferably from about 6 millimeters to about 16 millimeters, more preferably from about 8 millimeters to about 16 millimeters, even more preferably from about 10 millimeters to about 16 millimeters.

An aerosol-generating article in accordance with the present invention may have a ventilation level of at least about 5 percent.

The term "ventilation level" is used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer.

The aerosol-generating article may typically have a ventilation level of at least about 10 percent, preferably at least about 15 percent, more preferably at least about 20 percent.

In preferred embodiments, the aerosol-generating article has a ventilation level of at least about 25 percent.

The aerosol-generating article preferably has a ventilation level of less than about 60 percent.

An aerosol-generating article in accordance with the present invention preferably has a ventilation level of less than or equal to about 45 percent. More preferably, an aerosol-generating article in accordance with the present invention has a ventilation level of less than or equal to about 40 percent, even more preferably less than or equal to about 35 percent.

In a particularly preferred embodiments, the aerosol-generating article has a ventilation level of about 30 percent.

In some embodiments, the aerosol-generating article has a ventilation level from about 20 percent to about 60 percent, preferably from about 20 percent to about 45 percent, more preferably from about 20 percent to about 40 percent. In other embodiments, the aerosol-generating article has a ventilation level from about 25 percent to about 60 percent, preferably from about 25 percent to about 45 percent, more preferably from about 25 percent to about 40 percent. In further embodiments, the aerosol-generating article has a ventilation level from about 30 percent to about 60 percent, preferably from about 30 percent to about 45 percent, more preferably from about 30 percent to about 40 percent.

In particularly preferred embodiments, the aerosol-generating article has a ventilation level from about 28 percent to about 42 percent. In some particularly preferred embodiments, the aerosol-generating article has a ventilation level of about 30 percent.

Without wishing to be bound by theory, the inventors have found that the temperature drop caused by the admission of cooler, external air into the hollow tubular segment via the ventilation zone may have an advantageous effect on the nucleation and growth of aerosol particles.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas—liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular segment via the ventilation zone can be favourably used to favour nucleation and growth of aerosol droplets. However, at the same time, the admission of external air into the hollow tubular segment has the immediate drawback of diluting the aerosol stream delivered to the consumer.

The inventors have surprisingly found how the favourable effect of enhanced nucleation promoted by the rapid cooling induced by the introduction of ventilation air into the article is capable of significantly countering the less desirable effects of dilution. As such, satisfactory values of aerosol delivery are consistently achieved with aerosol-generating articles in accordance with the invention.

The inventors have also surprisingly found that the diluting effect on the aerosol—which can be assessed by measuring, in particular, the effect on the delivery of aerosol former (such as glycerol) included in the aerosol-generating substrate) is advantageously minimised when the ventilation level is within the ranges described above. In particular, ventilation levels between 25 percent and 50 percent, and even more preferably between 28 and 42 percent, have been found to lead to particularly satisfactory values of glycerin delivery. At the same time, the extent of nucleation and, as a consequence, the delivery of nicotine and aerosol-former (for example, glycerol) are enhanced.

This is particularly advantageous with "short" aerosol-generating articles, such as ones wherein a length of the rod of aerosol-generating substrate is less than about 40 millimeters, preferably less than 25 millimeters, even more preferably less than 20 millimeters, or wherein an overall length of the aerosol-generating article is less than about 70 millimeters, preferably less than about 60 millimeters, even more preferably less than 50 millimeters. As will be appreciated, in such aerosol-generating articles, there is little time and space for the aerosol to form and for the particulate phase of the aerosol to become available for delivery to the consumer.

Further, because the ventilated hollow tubular segment substantially does not contribute to the overall RTD of the aerosol-generating article, in aerosol-generating articles in accordance with the invention the overall RTD of the article can advantageously be fine-tuned by adjusting the length and density of the rod of aerosol-generating substrate or the length and optionally the length and density of a segment of filtration material forming part of the mouthpiece or the length and density of a segment of filtration material provided upstream of the aerosol-generating substrate and the susceptor. Thus, aerosol-generating articles that have a predetermined RTD can be manufactured consistently and with great precision, such that satisfactory levels of RTD can be provided for the consumer even in the presence of ventilation.

In some embodiments wherein the intermediate hollow section comprises both a support element comprising a first hollow tube segment and an aerosol-cooling element comprising a second hollow tubular segment, the internal diameter ($D_{STS}$) of the second hollow tubular segment is preferably greater than the internal diameter ($D_{FTS}$) of the first hollow tubular segment.

In more detail, a ratio between the internal diameter ($D_{STS}$) of the second hollow tubular segment and the internal diameter ($D_{FTS}$) of the first hollow tubular segment is preferably at least about 1.25. More preferably, a ratio between the internal diameter ($D_{STS}$) of the second hollow tubular segment and the internal diameter ($D_{FTS}$) of the first hollow tubular segment is preferably at least about 1.3. Even more preferably, a ratio between the internal diameter ($D_{STS}$) of the second hollow tubular segment and the internal diameter ($D_{FTS}$) of the first hollow tubular segment is preferably at least about 1.4. In particularly preferred embodiments, a ratio between the internal diameter ($D_{STS}$) of the second hollow tubular segment and the internal diameter ($D_{FTS}$) of the first hollow tubular segment is at least about 1.5, more preferably at least about 1.6.

A ratio between the internal diameter ($D_{STS}$) of the second hollow tubular segment and the internal diameter ($D_{FTS}$) of the first hollow tubular segment is preferably less than or equal to about 2.5. More preferably, a ratio between the internal diameter ($D_{STS}$) of the second hollow tubular segment and the internal diameter ($D_{FTS}$) of the first hollow tubular segment is preferably less than or equal to about 2.25. Even more preferably, ratio between the internal diameter ($D_{STS}$) of the second hollow tubular segment and the internal diameter ($D_{FTS}$) of the first hollow tubular segment is preferably less than or equal to about 2.

In some embodiments, a ratio between the internal diameter ($D_{STS}$) of the second hollow tubular segment and the internal diameter ($D_{FTS}$) of the first hollow tubular segment is from about 1.25 to about 2.5. Preferably, a ratio between the internal diameter ($D_{STS}$) of the second hollow tubular segment and the internal diameter ($D_{FTS}$) of the first hollow tubular segment is from about 1.3 to about 2.5. More preferably, a ratio between the internal diameter ($D_{STS}$) of the second hollow tubular segment and the internal diameter ($D_{FTS}$) of the first hollow tubular segment is from about 1.4 to about 2.5. In particularly preferred embodiments, a ratio between the internal diameter ($D_{STS}$) of the second hollow tubular segment and the internal diameter ($D_{FTS}$) of the first hollow tubular segment is from about 1.5 to about 2.5.

In other embodiments, a ratio between the internal diameter ($D_{STS}$) of the second hollow tubular segment and the internal diameter ($D_{FTS}$) of the first hollow tubular segment is from about 1.25 to about 2.25. Preferably, a ratio between the internal diameter ($D_{STS}$) of the second hollow tubular segment and the internal diameter ($D_{FTS}$) of the first hollow tubular segment is from about 1.3 to about 2.25. More preferably, a ratio between the internal diameter ($D_{STS}$) of the second hollow tubular segment and the internal diameter ($D_{FTS}$) of the first hollow tubular segment is from about 1.4 to about 2.25. In particularly preferred embodiments, a ratio between the internal diameter ($D_{STS}$) of the second hollow tubular segment and the internal diameter ($D_{FTS}$) of the first hollow tubular segment is from about 1.5 to about 2.25.

In further embodiments, a ratio between the internal diameter ($D_{STS}$) of the second hollow tubular segment and the internal diameter ($D_{FTS}$) of the first hollow tubular segment is from about 1.25 to about 2. Preferably, a ratio between the internal diameter ($D_{STS}$) of the second hollow tubular segment and the internal diameter ($D_{FTS}$) of the first hollow tubular segment is from about 1.3 to about 2. More preferably, a ratio between the internal diameter ($D_{STS}$) of the second hollow tubular segment and the internal diameter ($D_{FTS}$) of the first hollow tubular segment is from about 1.4 to about 2. In particularly preferred embodiments, a ratio between the internal diameter ($D_{STS}$) of the second hollow tubular segment and the internal diameter ($D_{FTS}$) of the first hollow tubular segment is from about 1.5 to about 2.

In those embodiments wherein the article further comprises an elongate susceptor arranged longitudinally within the aerosol-generating substrate, as described below, a ratio between the internal diameter ($D_{FTS}$) of the first hollow tubular segment and a width of the susceptor is preferably at least about 0.2. More preferably, a ratio between the internal diameter (DF-s) of the first hollow tubular segment and a width of the susceptor is at least about 0.3. Even more preferably, a ratio between the internal diameter ($D_{FTS}$) of the first hollow tubular segment and a width of the susceptor is at least about 0.4.

In addition, or as an alternative, a ratio between the internal diameter ($D_{STS}$) of the second hollow tubular segment and a width of the susceptor is preferably at least about 0.2. More preferably, a ratio between the internal diameter ($D_{STS}$) of the second hollow tubular segment and a width of the susceptor is at least about 0.5. Even more preferably, a ratio between the internal diameter ($D_{STS}$) of the second hollow tubular segment and a width of the susceptor is at least about 0.8.

Preferably, a ratio between a volume of the cavity of the first hollow tubular segment and a volume of the cavity of the second hollow tubular segment is at least about 0.1. More preferably, a ratio between a volume of the cavity of the first hollow tubular segment and a volume of the cavity of second hollow tubular segment is at least about 0.2. Even more preferably, a ratio between a volume of the cavity of first hollow tubular segment and a volume of the cavity of second hollow tubular segment is at least about 0.3.

A ratio between a volume of the cavity of the first hollow tubular segment and a volume of the cavity of the second hollow tubular segment is preferably less than or equal to about 0.9. More preferably, a ratio between a volume of the cavity of the first hollow tubular segment and a volume of the cavity of the second hollow tubular segment is preferably less than or equal to about 0.7. Even more preferably, a ratio between a volume of the cavity of the first hollow tubular segment and a volume of the cavity of the second hollow tubular segment is preferably less than or equal to about 0.5.

In some embodiments, the aerosol-generating article may further comprise an additional cooling element, such as at a location downstream of the aerosol-cooling element comprising a hollow tubular segment as described above, wherein the additional aerosol-cooling element defines a plurality of longitudinally extending channels such as to make a high surface area available for heat exchange. In other words, one such additional cooling element is adapted to function substantially as a heat exchanger. The plurality of longitudinally extending channels may be defined by a sheet material that has been pleated, gathered or folded to form the channels. The plurality of longitudinally extending channels may be defined by a single sheet that has been pleated, gathered or folded to form multiple channels. The sheet may also have been crimped prior to being pleated, gathered or folded. Alternatively, the plurality of longitudinally extending channels may be defined by multiple sheets that have been crimped, pleated, gathered or folded to form multiple channels. In some embodiments, the plurality of longitudinally extending channels may be defined by multiple sheets that have been crimped, pleated, gathered or folded together—that is by two or more sheets that have been brought into overlying arrangement and then crimped, pleated, gathered or folded as one. As used herein, the term 'sheet' denotes a laminar element having a width and length substantially greater than the thickness thereof.

As used herein, the term 'longitudinal direction' refers to a direction extending along, or parallel to, the cylindrical axis of a rod. As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod. As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

One such additional cooling element may have a total surface area of between about 300 square millimeter per millimeter length and about 1000 square millimeters per millimeter length.

The additional cooling element preferably offers a low resistance to the passage of air through additional cooling element. Preferably, the additional cooling element does not substantially affect the resistance to draw of the aerosol-generating article. To achieve this, it is preferred that the porosity in a longitudinal direction is greater than 50 percent and that the airflow path through the additional cooling element is relatively uninhibited. The longitudinal porosity of the additional cooling element may be defined by a ratio of the cross-sectional area of material forming the additional cooling element and an internal cross-sectional area of the aerosol-generating article at the portion containing the additional cooling element.

The additional cooling element preferably comprises a sheet material selected from the group comprising a metallic foil, a polymeric sheet, and a substantially non-porous paper or cardboard. In some embodiments, the aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil. In a particularly preferred embodiment, the additional cooling element comprises a sheet of PLA.

In other embodiments, the aerosol-cooling element may alternatively be provided in the form of one such cooling element comprising a plurality of longitudinally extending channels.

In preferred embodiments, the aerosol-generating article further comprises an upstream section at a location upstream of the rod of aerosol-generating substrate. The upstream section may comprise one or more upstream elements. In particular, the upstream section may comprise an upstream element arranged immediately upstream of the rod of aerosol-generating substrate.

The upstream element advantageously prevents direct physical contact with the upstream end of the aerosol-generating substrate. In particular, where the aerosol-generating substrate comprises a susceptor element, the upstream element may prevent direct physical contact with the upstream end of the susceptor element. This helps to prevent the displacement or deformation of the susceptor element during handling or transport of the aerosol-generating article. This in turn helps to secure the form and position of the susceptor element. Furthermore, the presence of an upstream element helps to prevent any loss of the substrate, which may be advantageous, for example, if the substrate contains particulate plant material.

The upstream element may also provide an improved appearance to the upstream end of the aerosol-generating article. Furthermore, if desired, the upstream element may be used to provide information on the aerosol-generating article, such as information on brand, flavour, content, or details of the aerosol-generating device that the article is intended to be used with.

The upstream element may be a porous plug element. Preferably, a porous plug element does not alter the resistance to draw of the aerosol-generating article. Preferably, the upstream element has a porosity of at least about 50 percent in the longitudinal direction of the aerosol-generating article. More preferably, the upstream element has a porosity of between about 50 percent and about 90 percent in the longitudinal direction. The porosity of the upstream element in the longitudinal direction is defined by the ratio of the cross-sectional area of material forming the upstream element and the internal cross-sectional area of the aerosol-generating article at the position of the upstream element.

The upstream element may be made of a porous material or may comprise a plurality of openings. This may, for example, be achieved through laser perforation. Preferably, the plurality of openings is distributed homogeneously over the cross-section of the upstream element.

The porosity or permeability of the upstream element may advantageously be varied in order to provide a desirable overall resistance to draw of the aerosol-generating article.

Preferably, the RTD of the upstream element is at least about 5 millimeters $H_2O$. More preferably, the RTD of the upstream element is at least about 10 millimeters $H_2O$. Even more preferably, the RTD of the upstream element is at least about 15 millimeters $H_2O$. In particularly preferred embodiments, the RTD of the upstream element is at least about 20 millimeters $H_2O$.

The RTD of the upstream element is less than or equal to about 80 millimeters $H_2O$. More preferably, the RTD of the upstream element is less than or equal to about 60 millimeters $H_2O$. Even more preferably, the RTD of the upstream element is less than or equal to about 40 millimeters $H_2O$.

In some embodiments, the RTD of the upstream element is from about 5 millimeters $H_2O$ to about 80 millimeters $H_2O$, preferably from about 10 millimeters $H_2O$ to about 80 millimeters $H_2O$, more preferably from about 15 millimeters $H_2O$ to about 80 millimeters $H_2O$, even more preferably from about 20 millimeters $H_2O$ to about 80 millimeters $H_2O$. In other embodiments, the RTD of the upstream element is from about 5 millimeters $H_2O$ to about 60 millimeters $H_2O$, preferably from about 10 millimeters $H_2O$ to about 60 millimeters $H_2O$, more preferably from about 15 millimeters $H_2O$ to about 60 millimeters $H_2O$, even more preferably from about 20 millimeters $H_2O$ to about 60 millimeters $H_2O$. In further embodiments, the RTD of the upstream element is from about 5 millimeters $H_2O$ to about 40 millimeters $H_2O$, preferably from about 10 millimeters $H_2O$ to about 40 millimeters $H_2O$, more preferably from about 15 millimeters $H_2O$ to about 40 millimeters $H_2O$, even more preferably from about 20 millimeters $H_2O$ to about 40 millimeters $H_2O$.

In alternative embodiments, the upstream element may be formed from a material that is impermeable to air. In such embodiments, the aerosol-generating article may be configured such that air flows into the rod of aerosol-generating substrate through suitable ventilation means provided in a wrapper.

The upstream element may be made of any material suitable for use in an aerosol-generating article. The upstream element may, for example, be made of a same material as used for one of the other components of the aerosol-generating article, such as the mouthpiece, the cooling element or the support element. Suitable materials for forming the upstream element include filter materials, ceramic, polymer material, cellulose acetate, cardboard, zeolite or aerosol-generating substrate. Preferably, the upstream element is formed from a plug of cellulose acetate.

Preferably, the upstream element is formed of a heat resistant material. For example, preferably the upstream element is formed of a material that resists temperatures of up to 350 degrees Celsius. This ensures that the upstream element is not adversely affected by the heating means for heating the aerosol-generating substrate.

Preferably, the upstream element has a diameter that is approximately equal to the diameter of the aerosol-generating article.

Preferably, the upstream element has a length of between about 1 millimeter and about 10 millimeters, more preferably between about 3 millimeters and about 8 millimeters, more preferably between about 4 millimeters and about 6 millimeters. In a particularly preferred embodiment, the upstream element has a length of about 5 millimeters. The length of the upstream element can advantageously be varied in order to provide the desired total length of the aerosol-generating article. For example, where it is desired to reduce the length of one of the other components of the aerosol-generating article, the length of the upstream element may be increased in order to maintain the same overall length of the article.

The upstream element preferably has a substantially homogeneous structure. For example, the upstream element may be substantially homogeneous in texture and appearance. The upstream element may, for example, have a continuous, regular surface over its entire cross section. The upstream element may, for example, have no recognisable symmetries.

The upstream element is preferably circumscribed by a wrapper. The wrapper circumscribing the upstream element is preferably a stiff plug wrap, for example, a plug wrap having a basis weight of at least about 80 grams per square metre (gsm), or at least about 100 gsm, or at least about 110 gsm. This provides structural rigidity to the upstream element.

In certain preferred embodiments of the present invention, the elements of the aerosol-generating article, as described above, are arranged such that the centre of mass of the aerosol-generating article is at least about 60 percent of the way along the length of the aerosol-generating article from the downstream end. More preferably, the elements of the aerosol-generating article are arranged such that the centre of mass of the aerosol-generating article is at least about 62 percent of the way along the length of the aerosol-generating article from the downstream end, more preferably at least about 65 percent of the way along the length of the aerosol-generating article from the downstream end.

Preferably, the centre of mass is no more than about 70 percent of the way along the length of the aerosol-generating article from the downstream end.

Providing an arrangement of elements that gives a centre of mass that is closer to the upstream end than the downstream end results in an aerosol-generating article having a weight imbalance, with a heavier upstream end. This weight imbalance may advantageously provide haptic feedback to the consumer to enable them to distinguish between the upstream and downstream ends so that the correct end can be inserted into an aerosol-generating device. This may be particularly beneficial where an upstream element is provided such that the upstream and downstream ends of the aerosol-generating article are visually similar to each other.

In embodiments of aerosol-generating articles in accordance with the invention, wherein both aerosol-cooling element and support element are present, these are preferably wrapped together in a combined wrapper. The combined wrapper circumscribes the aerosol-cooling element and the support element, but does not circumscribe a further downstream, such as a mouthpiece element.

In these embodiments, the aerosol-cooling element and the support element are combined prior to being circumscribed by the combined wrapper, before they are further combined with the mouthpiece segment.

From a manufacturing viewpoint, this is advantageous in that it enables shorter aerosol-generating articles to be assembled.

In general, it may be difficult to handle individual elements that have a length smaller than their diameter. For example, for elements with a diameter of 7 millimeters, a length of about 7 millimeters represents a threshold value close to which it is preferable not to go. However, an aerosol-cooling element of 10 millimeters can be combined with a pair of support elements of 7 millimeters on each side (and potentially with other elements like the rod of aerosol-generating substrate, etc.) to provide a hollow segment of 24 millimeters, which is subsequently cut into two intermediate hollow sections of 12 millimeters.

In particularly preferred embodiments, the other components of the aerosol-generating article are individually circumscribed by their own wrapper. In other words, the upstream element, the rod of aerosol-generating substrate, the support element, and the aerosol-cooling element are all individually wrapped. The support element and the aerosol-cooling element are combined to form the intermediate hollow section. This is achieved by wrapping the support element and the aerosol-cooling element by means of a combined wrapper. The upstream element, the rod of aerosol-generating substrate, and the intermediate hollow section are then combined together with an outer wrapper. Subsequently, they are combined with the mouthpiece element—which has a wrapper of its own—by means of tipping paper.

Preferably, at least one of the components of the aerosol-generating article is wrapped in a hydrophobic wrapper.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

In preferred embodiments, the hydrophobic wrapper is one including a paper layer having a water contact angle of about 30 degrees or greater, and preferably about 35 degrees or greater, or about 40 degrees or greater, or about 45 degrees or greater.

By way of example, the paper layer may comprise PVOH (polyvinyl alcohol) or silicon. The PVOH may be applied to the paper layer as a surface coating, or the paper layer may comprise a surface treatment comprising PVOH or silicon.

In a particularly preferred embodiment, an aerosol-generating article in accordance with the present invention comprises, in linear sequential arrangement, an upstream element, a rod of aerosol-generating substrate located immediately downstream of the upstream element, a support element located immediately downstream of the rod of aerosol-generating substrate, an aerosol-cooling element located immediately downstream of the support element, a mouthpiece element located immediately downstream of the aerosol-cooling element, and an outer wrapper circumscribing the upstream element, the support element, the aerosol-cooling element and the mouthpiece element.

In more detail, the rod of aerosol-generating substrate may abut the upstream element. The support element may abut the rod of aerosol-generating substrate. The aerosol-cooling element may abut the support element. The mouthpiece element may abut the aerosol-cooling element.

The aerosol-generating article has a substantially cylindrical shape and an outer diameter of about 7.25 millimeters.

The upstream element has a length of about 5 millimeters, the rod of aerosol-generating article has a length of about 12 millimeters, the support element has a length of about 8 millimeters, the mouthpiece element has a length of about 12 millimeters. Thus, an overall length of the aerosol-generating article is about 45 millimeters.

The upstream element is in the form of a plug of cellulose acetate wrapped in stiff plug wrap.

The aerosol-generating article comprises an elongate susceptor arranged substantially longitudinally within the rod of aerosol-generating substrate and is in thermal contact with the aerosol-generating substrate. The susceptor is in the form of a strip or blade, has a length substantially equal to the length of the rod of aerosol-generating substrate and a thickness of about 60 micrometres.

The support element is in the form of a hollow cellulose acetate tube and has an internal diameter of about 1.9 millimeters. Thus, a thickness of a peripheral wall of the support element is about 2.675 millimeters.

The aerosol-cooling element is in the form of a finer hollow cellulose acetate tube and has an internal diameter of about 3.25 millimeters. Thus, a thickness of a peripheral wall of the aerosol-cooling element is about 2 millimeters.

The mouthpiece is in the form of a low-density cellulose acetate filter segment.

The rod of aerosol-generating substrate comprises at least one of the types of aerosol-generating substrate described above, such as homogenised tobacco, a gel formulation or a homogenised plant material comprising particles of a plant other than tobacco.

Figure 2:
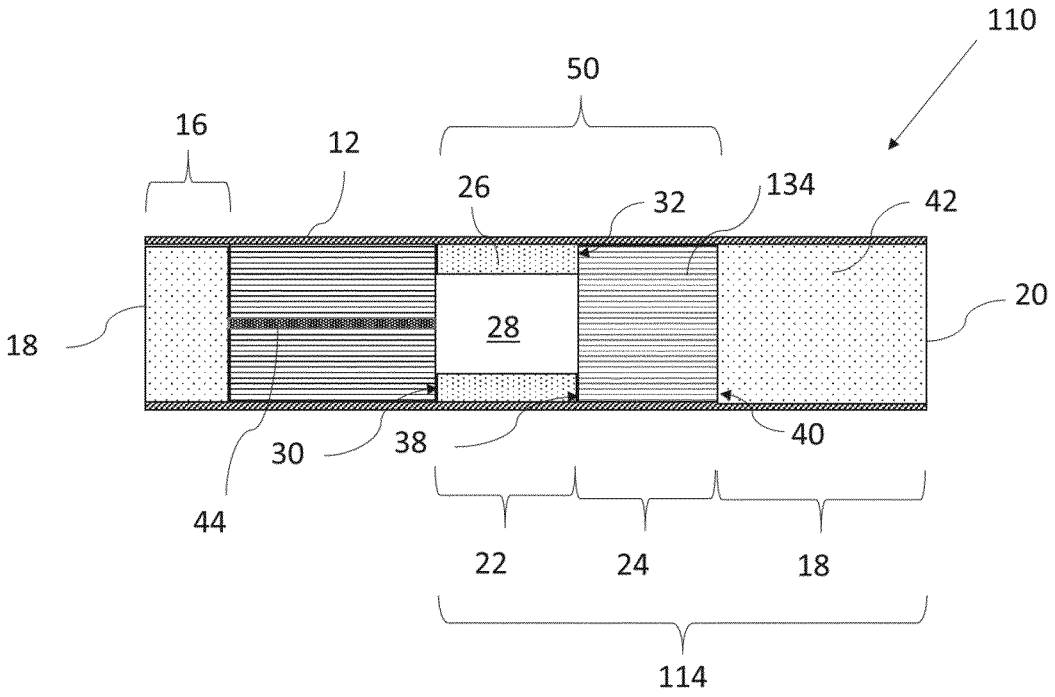

In the following, the invention will be further described with reference to the drawings of the accompanying Figures, wherein:

FIG. 1 shows a schematic side sectional view of an aerosol-generating article in accordance with the invention; and FIG. 2 shows a schematic side sectional view of another aerosol-generating article in accordance with the invention.

In the following, the invention will be further described with reference to the drawing of the accompanying FIG. 1, which shows a schematic side sectional view of an aerosol-generating article in accordance with the invention.

The aerosol-generating article 10 shown in FIG. 1 comprises a rod 12 of aerosol-generating substrate 12 and a downstream section 14 at a location downstream of the rod 12 of aerosol-generating substrate. Further, the aerosol-generating article 10 comprises an upstream section 16 at a location upstream of the rod 12 of aerosol-generating substrate. Thus, the aerosol-generating article 10 extends from an upstream or distal end 18 to a downstream or mouth end 20.

The aerosol-generating article has an overall length of about 45 millimeters.

The downstream section 14 comprises a support element 22 located immediately downstream of the rod 12 of aerosol-generating substrate, the support element 22 being in longitudinal alignment with the rod 12. In the embodiment of FIG. 1, the upstream end of the support element 18 abuts the downstream end of the rod 12 of aerosol-generating substrate. In addition, the downstream section 14 comprises an aerosol-cooling element 24 located immediately downstream of the support element 22, the aerosol-cooling element 24 being in longitudinal alignment with the rod 12 and the support element 22. In the embodiment of FIG. 1, the upstream end of the aerosol-cooling element 24 abuts the downstream end of the support element 22.

As will become apparent from the following description, the support element 22 and the aerosol-cooling element 24 together define an intermediate hollow section 50 of the aerosol-generating article 10. As a whole, the intermediate hollow section 50 does not substantially contribute to the overall RTD of the aerosol-generating article. An RTD of the intermediate hollow section 26 as a whole is substantially 0 millimeters $H_2O$.

The support element 22 comprises a first hollow tubular segment 26. The first hollow tubular segment 26 is provided in the form of a hollow cylindrical tube made of cellulose acetate. The first hollow tubular segment 26 defines an internal cavity 28 that extends all the way from an upstream end 30 of the first hollow tubular segment to an downstream end 32 of the first hollow tubular segment 20. The internal cavity 28 is substantially empty, and so substantially unrestricted airflow is enabled along the internal cavity 28. The first hollow tubular segment 26—and, as a consequence, the support element 22—does not substantially contribute to the overall RTD of the aerosol-generating article 10. In more detail, the RTD of the first hollow tubular segment 26 (which is essentially the RTD of the support element 22) is substantially 0 millimeters $H_2O$.

The first hollow tubular segment 26 has a length of about 8 millimeters, an external diameter of about 7.25 millimeters, and an internal diameter ($D_{FTS}$) of about 1.9 millimeters. Thus, a thickness of a peripheral wall of the first hollow tubular segment 26 is about 2.67 millimeters.

The aerosol-cooling element 24 comprises a second hollow tubular segment 34. The second hollow tubular segment 34 is provided in the form of a hollow cylindrical tube made of cellulose acetate. The second hollow tubular segment 34 defines an internal cavity 36 that extends all the way from an upstream end 38 of the second hollow tubular segment to a downstream end 40 of the second hollow tubular segment 34. The internal cavity 36 is substantially empty, and so substantially unrestricted airflow is enabled along the internal cavity 36. The second hollow tubular segment 28—and, as a consequence, the aerosol-cooling element 24—does not substantially contribute to the overall RTD of the aerosol-generating article 10. In more detail, the RTD of the second hollow tubular segment 34 (which is essentially the RTD of the aerosol-cooling element 24) is substantially 0 millimeters $H_2O$.

The second hollow tubular segment 34 has a length of about 8 millimeters, an external diameter of about 7.25 millimeters, and an internal diameter ($D_{STS}$) of about 3.25 millimeters. Thus, a thickness of a peripheral wall of the second hollow tubular segment 34 is about 2 millimeters. Thus, a ratio between the internal diameter ($D_{FTS}$) of the first hollow tubular segment 26 and the internal diameter ($D_{STS}$) of the second hollow tubular segment 34 is about 0.75.

The aerosol-generating article 10 comprises a ventilation zone 60 provided at a location along the second hollow tubular segment 34. In more detail, the ventilation zone is provided at about 2 millimeters from the upstream end of the second hollow tubular segment 34. A ventilation level of the aerosol-generating article 10 is about 25 percent.

In the embodiment of FIG. 1, the downstream section 14 further comprises a mouthpiece element 42 at a location downstream of the intermediate hollow section 50. In more detail, the mouthpiece element 42 is positioned immediately downstream of the aerosol-cooling element 24. As shown in the drawing of FIG. 1, an upstream end of the mouthpiece element 42 abuts the downstream end 40 of the aerosol-cooling element 18.

The mouthpiece element 42 is provided in the form of a cylindrical plug of low-density cellulose acetate.

The mouthpiece element 42 has a length of about 12 millimeters and an external diameter of about 7.25 millimeters. The RTD of the mouthpiece element 42 is about 12 millimeters $H_2O$.

The rod 12 comprises an aerosol-generating substrate of one of the types described above.

The rod 12 of aerosol-generating substrate has an external diameter of about 7.25 millimeters and a length of about 12 millimeters.

The aerosol-generating article 10 further comprises an elongate susceptor 44 within the rod 12 of aerosol-generating substrate. In more detail, the susceptor 44 is arranged substantially longitudinally within the aerosol-generating substrate, such as to be approximately parallel to the longitudinal direction of the rod 12. As shown in the drawing of FIG. 1, the susceptor 44 is positioned in a radially central position within the rod and extends effectively along the longitudinal axis of the rod 12.

The susceptor 44 extends all the way from an upstream end to a downstream end of the rod 12. In effect, the susceptor 44 has substantially the same length as the rod 12 of aerosol-generating substrate.

In the embodiment of FIG. 1, the susceptor 44 is provided in the form of a strip and has a length of about 12 millimeters, a thickness of about 60 micrometres, and a width of about 4 millimeters. The upstream section 16 comprises an upstream element 46 located immediately upstream of the rod 12 of aerosol-generating substrate, the upstream element 46 being in longitudinal alignment with the rod 12. In the embodiment of FIG. 1, the downstream end of the upstream element 46 abuts the upstream end of the rod 12 of aerosol-generating substrate. This advantageously prevents the susceptor 44 from being dislodged. Further, this ensures that the consumer cannot accidentally contact the heated susceptor 44 after use.

The upstream element 46 is provided in the form of a cylindrical plug of cellulose acetate circumscribed by a stiff wrapper. The upstream element 46 has a length of about 5 millimeters.

The RTD of the upstream element 46 is about 30 millimeters $H_2O$.

The aerosol-generating article 110 shown in FIG. 2 has substantially the same overall structure of the aerosol-generating article 10 of FIG. 1, and will be described below insofar as it differs from the aerosol-generating article 10.

As shown in FIG. 2, the aerosol-generating article 110 comprises a rod 12 of aerosol-generating substrate 12 and a modified downstream section 114 at a location downstream of the rod 12 of aerosol-generating substrate. Further, the aerosol-generating article 10 comprises an upstream section 16 at a location upstream of the rod 12 of aerosol-generating substrate.

Like the downstream section 14 of the aerosol-generating article 10, the modified downstream section 114 of the aerosol-generating article 110 comprises a support element 22 located immediately downstream of the rod 12 of aerosol-generating substrate, the support element 22 being in longitudinal alignment with the rod 12, wherein the upstream end of the support element 22 abuts the downstream end of the rod 12 of aerosol-generating substrate.

Further, the modified downstream section 114 comprises an aerosol-cooling element 124 located immediately downstream of the support element 22, the aerosol-cooling element 124 being in longitudinal alignment with the rod 12 and the support element 22. In more detail, the upstream end of the aerosol-cooling element 124 abuts the downstream end of the support element 22.

In contrast to downstream section 14 of the aerosol-generating article 10, the aerosol-cooling element 124 of the modified downstream section 114 comprises a plurality of longitudinally extending channels which offer a low or substantially null resistance to the passage of air through the rod. In more detail, the aerosol-cooling element 124 is formed from a preferably non-porous sheet material selected from the group comprising a metallic foil, a polymeric sheet, and a substantially non-porous paper or cardboard. In particular, in the embodiment illustrated in FIG. 2, the aerosol-cooling element 124 is provided in the form of a crimped and gathered sheet of polylactic acid (PLA). The aerosol-cooling element 124 has a length of about 8 millimeters, and an external diameter of about 7.25 millimeters.

The invention claimed is:

1. An aerosol-generating article for producing an inhalable aerosol upon heating, the aerosol-generating article extending from a mouth end to a distal end upstream from the mouth end, and comprising:

a rod of aerosol-generating substrate;

a downstream section at a location downstream of the rod of aerosol-generating substrate, wherein the downstream section comprises a mouthpiece element positioned downstream of the rod and in longitudinal alignment with the rod, the mouthpiece element extending all the way to the mouth end of the aerosol-generating article;

an upstream section located upstream of the rod of aerosol-generating substrate, the upstream section comprising an upstream element comprising a segment of filtration material and extending all the way to a distal end of the article; and a first band of tipping paper at least partially circumscribing the mouthpiece element and affixing the mouthpiece to an immediately adjacent, upstream component of the aerosol-generating article, and a second band of tipping paper circumscribing the first band of tipping paper, wherein a diameter (DME) of the aerosol-generating article at the mouth end is greater than a diameter (DDE) of the aerosol-generating article at the distal end, a ratio (DME/DDE) between the diameter (DME) of the aerosol-generating article at the mouth end and the diameter (DDE) of the aerosol-generating article at the distal end being at least 1.005.

2. The aerosol-generating article according to claim 1, wherein the ratio (DME/DDE) between the diameter (DME) of the aerosol-generating article at the mouth end and the diameter (DDE) of the aerosol-generating article at the distal end is at least 1.05.

3. The aerosol-generating article according to claim 1, wherein a difference between the diameter (DME) of the aerosol-generating article at the mouth end and the diameter (DDE) of the aerosol-generating article at the distal end is at least 100 micrometers.

4. The aerosol-generating article according to claim 1, further comprising an elongate susceptor arranged longitudinally within the rod of aerosol-generating substrate.

5. The aerosol-generating article according to claim 1, wherein a diameter of the upstream section is greater than a diameter of the rod of aerosol-generating substrate.

6. The aerosol-generating article according to claim 1, wherein the downstream section further comprises a support element positioned immediately downstream of, and in longitudinal alignment with, the rod of aerosol-generating substrate.

7. The aerosol-generating article according to claim 6, wherein the downstream section further comprises an aerosol-cooling element positioned immediately downstream of the support element, the aerosol-cooling element comprising a hollow tubular segment defining a cavity that extends all the way from an upstream end of the hollow tubular segment to a downstream end of the hollow tubular segment.

8. The aerosol-generating article according to claim 7, further comprising a ventilation zone at a location along the hollow tubular segment.

9. The aerosol-generating article according to claim 8, wherein the aerosol-generating article has a ventilation level of at least 10 percent.

10. The aerosol-generating article according to claim 1, wherein the aerosol-generating substrate comprises at least 10 percent by weight of an aerosol former on a dry weight basis.

* * * * *